US005394658A

United States Patent [19]

Schreiner et al.

[11] Patent Number: 5,394,658

[45] Date of Patent: Mar. 7, 1995

[54] FREE STANDING MODULAR FURNITURE AND WALL SYSTEM

[76] Inventors: Charles P. Schreiner, P.O. Box 711; Travis M. Randolph, P.O. Box 505, both of Saugatuck, Mich. 49453

[21] Appl. No.: 921,314

[22] Filed: Jul. 28, 1992

Related U.S. Application Data

[63] Continuation of Ser. No. 787,678, Nov. 4, 1991, abandoned, which is a continuation of Ser. No. 226,433, Jul. 29, 1988, abandoned.

[51] Int. Cl.[6] ..... A47B 5/00

[52] U.S. Cl. ..... 52/36.1; 312/223.6; 312/196; 52/239; 52/220.7

[58] Field of Search ..... 52/36, 220, 221, 239, 52/241, 36.1, 36.2, 36.4, 36.5; 160/135, 351, 230; 312/223.6, 194, 196; 108/50

[56] References Cited

U.S. PATENT DOCUMENTS

| | | | |
|---|---|---|---|
| 3,207,097 | 9/1965 | Schreyer | 312/194 |
| 4,224,769 | 9/1980 | Ball et al. | 52/36.1 |
| 4,637,177 | 1/1987 | Long | 52/36 |
| 4,685,255 | 8/1987 | Kelley | 52/36 |
| 4,874,027 | 10/1989 | Bowndy et al. | 82/36 X |
| 4,875,418 | 10/1989 | Moedel et al. | 108/50 |
| 5,038,539 | 8/1991 | Kelley et al. | 52/36 X |

*Primary Examiner*—Lanna Mai
*Assistant Examiner*—Kien Nguyen
*Attorney, Agent, or Firm*—Waters & Morse

[57] ABSTRACT

An integral room divider panel and freestanding desk system comprises a base wall formed of interconnected modular base wall panels of uniform height and width and a freestanding desk unit that integrates into the base wall. The desk unit includes a work surface supported at side edges by vertical support members, with a back panel extending across the back of the desk. The desk back panel is formed of modules of the same height and width as the base wall panels and have the same appearance as base wall panels, so the back of the desk can comprise a section of the base wall. The top of the desk is recessed from the vertical support members and back panel so that the modular upper wall panels can be mounted on the back panel and vertical support members, as well as on the base wall panels, to selectively increase the height of the wall panel system and the peripheral enclosure for the desk. A transverse support beam with an open interior is mounted under the work surface, and hollow inclined frame members attach the support beam to the vertical support members, providing wiring access to the desk top. A separate wall and post and beam archistructure system complements the desk and panel system.

9 Claims, 22 Drawing Sheets

FIG. 1

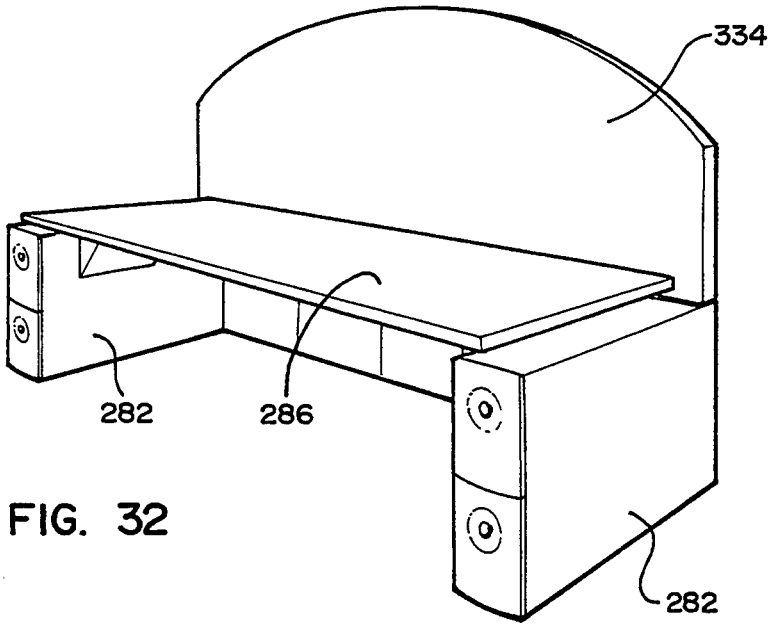
FIG. 32
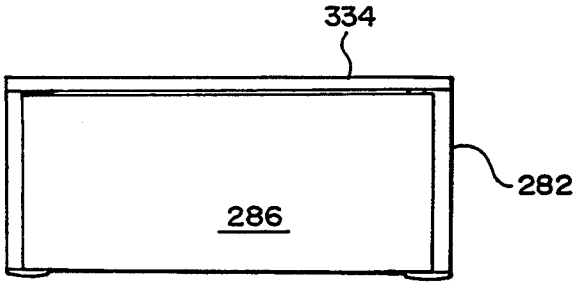
FIG. 33
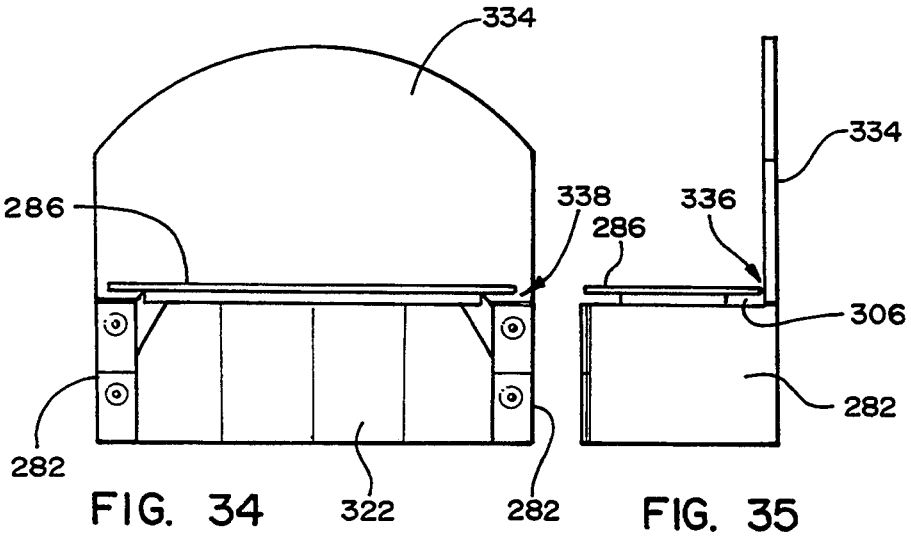
FIG. 34
FIG. 35

FREE STANDING MODULAR FURNITURE AND WALL SYSTEM

CROSS REFERENCE TO RELATED APPLICATION

This is a continuation of applicant's patent application, Ser. No. 787,678, filed Nov. 4, 1991, for FREE STANDING MODULAR FURNITURE AND WALL SYSTEM, which is a continuation of Ser. No. 226,433, filed Jul. 29, 1988, both now abandoned.

BACKGROUND OF THE INVENTION

Open office panel systems, commercialized heavily for the past twenty years, have a number of drawbacks. While they have been promoted as being versatile, movable systems that permit easy office re-arrangement, this has not proven to be the case. A complete partition or panel system involves numerous parts, and a completely assembled systems, have so many inter-dependent components and complicated fasteners that it is a difficult task, requiring special skills, in order to make adjustments in an open plan layout after the system has been installed. The complexities of the systems and number of parts involved make initial installation complex, and modification of an existing system involves similar difficulties.

Open Office panel systems also have functional drawbacks. Such panels typically are thin and flimsy. Moreover, such panels were originally developed prior to the availability of personal computers and heavy use of power and communications wiring for desk top and work station applications. Attempts have been made to accommodate electrical and electronic wiring in open office panel systems, but these attempts have met with limited success with wiring still being difficult, generally inadequate, or at least aesthetically unappealing, for the modern electronic office environment.

Open office panel systems generally provide load bearing walls, with desk tops, shelving, and storage units necessarily being mounted on the panels themselves. This requires that the panels be structurally capable of supporting such loads and, it necessarily limits the variation of office furniture available to individual office workers to a limited range of wall hung furniture.

The concept and appearance of open panel systems also has produced some user dissatisfactions based on emotional considerations. The thin walls, open doorways and general sameness of appearance tends to create a feeling of monotony and produces a maze-like appearance in an office environment. Office workers get the feeling that they are in temporary quarters with little privacy or individuality or importance.

As a result of the obsolescence and growing dissatisfaction with conventional open plan partition systems, there has been renewed interest in traditional office desks and office furniture, notwithstanding the limitations in such systems that caused the development of the open office partition systems in the first place.

It is an object of the present invention to provide an improved free standing office furniture and wall system that possesses the desirable features of both free standing desks and panel systems while substantially overcoming the limitations in both systems.

SUMMARY OF THE INVENTION

In accordance with the present invention, an improved free standing modular furniture and wall system comprises a series of compatible components including a free standing post and beam or archistructure system, a compatible free standing, non-load bearing wall system, and a compatible series of free standing desks and screens. All of the components are modular in nature, with a limited number of separate components providing an extremely wide array of office environment choices. All of the components are integrally designed for almost unlimited flexibility in layout and arrangement and re-arrangement of the office environment, maximum individual identity of the offices, aisleways, and common areas, and an almost unlimited ability to easily and invisibly bring safe electrical and electronic wiring to the individual work stations and to change such wiring at will without structural modifications or tools.

These and other features of the present invention are described in detail in connection with preferred embodiments of the invention, which are described in detail below and shown in the appended drawings.

BRIEF DESCRIPTION OF THE DRAWINGS

FIG. 32 is a perspective view a desk of the type shown in FIG. 28 employing a privacy screen.

FIG. 33 is a top plan view of the desk of FIG. 32.

FIG. 34 is a front elevational view of the desk of FIG. 32.

FIG. 35 is an end view of the desk of FIG. 32.

DETAILED DESCRIPTION OF THE PREFERRED EMBODIMENTS

Figure 1:
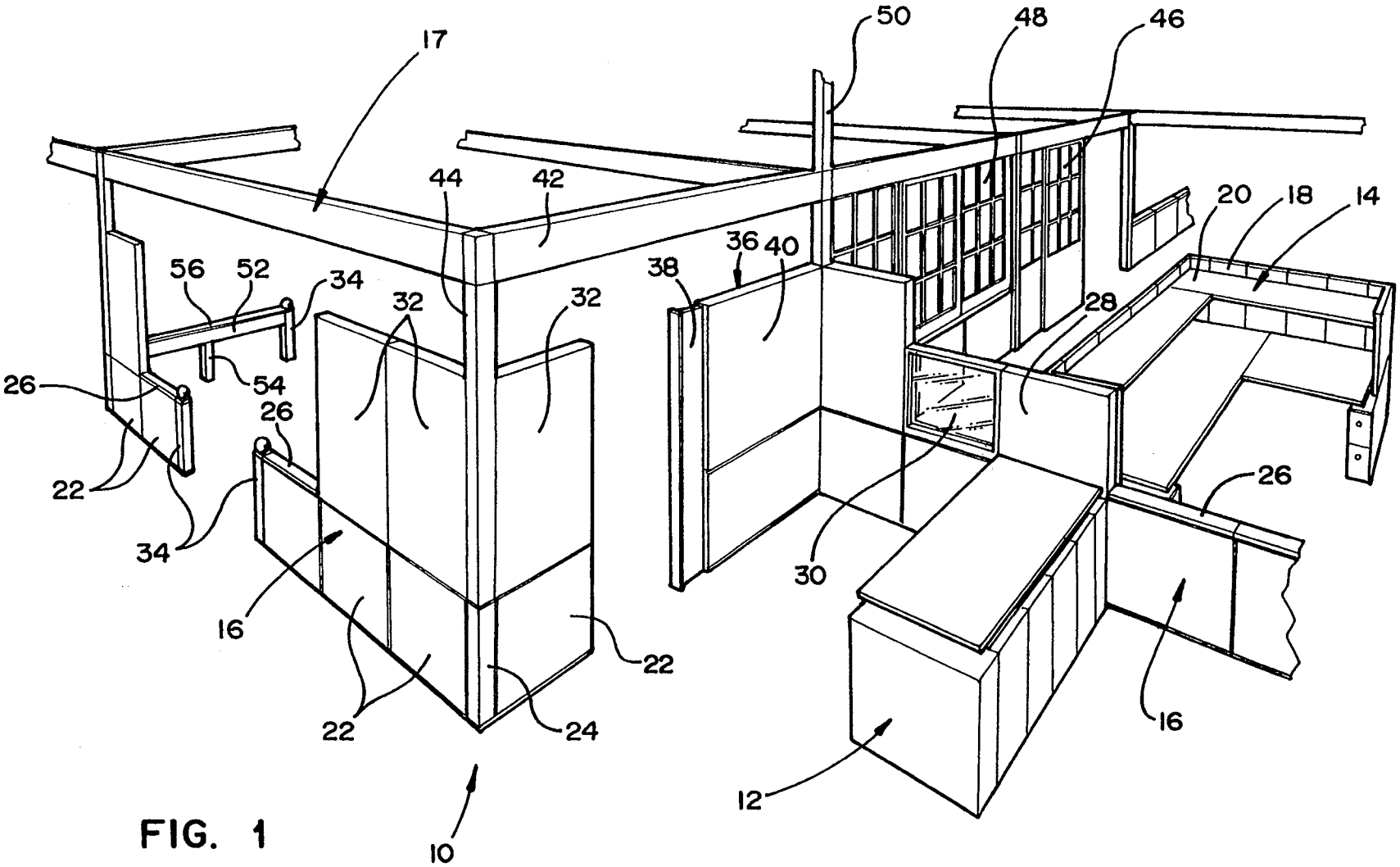
FIG. 1 is a perspective view of an office layout employing the furniture system of the present invention.

Referring to the drawings, FIG. 1 discloses a perspective view of a typical office lay-out employing the furniture and wall system of the present invention. The system 10 comprises three basic elements: free standing desks 12 and 14; a free standing wall shown generally as 16; and a free standing post and beam assembly, sometimes referred to as archistructure and shown generally by numeral 17. These three elements, combined together, create a highly individualized office environment with clearly defined aisleways and offices, and with a maximum amount of flexibility of doors, windows, and wall constructions. All of the components in this system are modular and all are easily assemblage and disassemblable for revision of the floor plan. While all of the components are related and closely compatible, at the same time they are free standing and separable.

Describing briefly the system components shown in FIG. 1, desk 12 is free standing and includes a work surface and pedestal mounting. The desk is free standing but abuts on one end the free standing wall 16. Another free standing desk 14 in the form of an "L" is positioned on the other side of partial wall 16. This desk is surrounded by a screen in the form of a series of back panels 18, to which shelves 20 are mounted in a manner described below.

The wall section system 16 comprises a plurality of lower wall sections 22 connected end to end in alignment, or at right angles by means of corner connectors 24. The lower wall sections are uniform in size and are constructed so that a number of components can be mounted on top of the lower wall sections. Some wall sections have a flat top cap 26 mounted on the top of the section. In other cases, a short wall top 28 or a short glass panel 30 is mounted on top of the wall section. In other cases, a tall wall top 32 is mounted on top of the lower wall sections. End connectors 34 are connected at the ends of some wall sections in order to make a doorway. A closed doorway may be provided by a separate pocket door unit 36. The pocket door unit has a sliding door 38 that fits within a recess in a pocket panel 40 (see FIG. 2).

The post and beam or "archistructure" system consists of a plurality of beams 42, all substantially the same, mounted on posts 44. The posts shown in FIG. 1 are wall posts that are mounted on the top of wall post supports or connectors 24 at ends of panels. The beams provide an improved definition of office and aisleway spaces and also provide a load supporting mechanism for supporting sliding full doors 46 and half doors or windows 48. A variety of other components described below also can be supported by or housed in the beams.

While the post and beam construction of the present invention is designed to be a free standing unit that is completely separate from the ceiling, if desired, a post extension 50 can be employed on top of a post in order to extend the post construction to or through the ceiling. This may be done in order to convey electrical wires to or from ceiling fixtures or to fasten the post to a ceiling beam in the event that a straight wall is constructed and there are no right angle walls to provide lateral support.

Another component shown in FIG. 1 is a beam 52 of the same construction as beam 42 mounted on a short pole 54 and attached to a conventional end connector 34 at the end. This beam may be provided with a top cap 56 similar to the top cap provided for the lower wall sections and can thus serve as a low railing.

Figure 2:
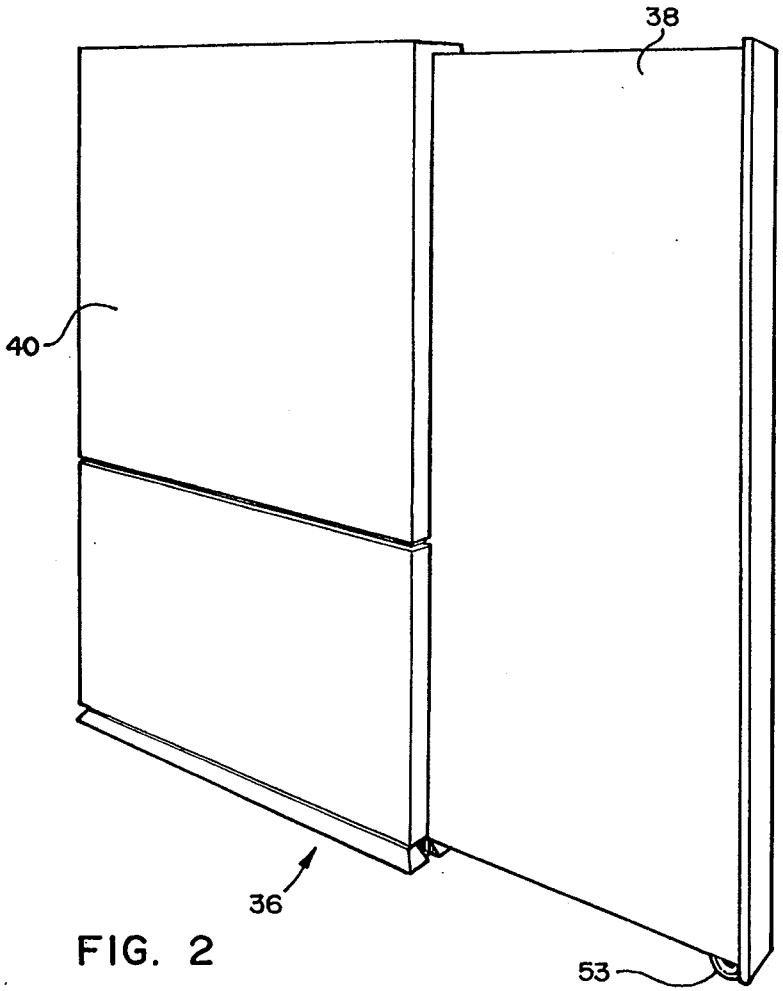
FIG. 2 is a perspective view of a pocket door of the present invention.

Detailed descriptions of the various components mentioned generally above are shown in the succeeding drawings. In FIG. 2, a pocket door is shown. The door rolls out of the pocket section 40 by means of a wheel 58 on the leading edge of the bottom of the door.

Figure 3:
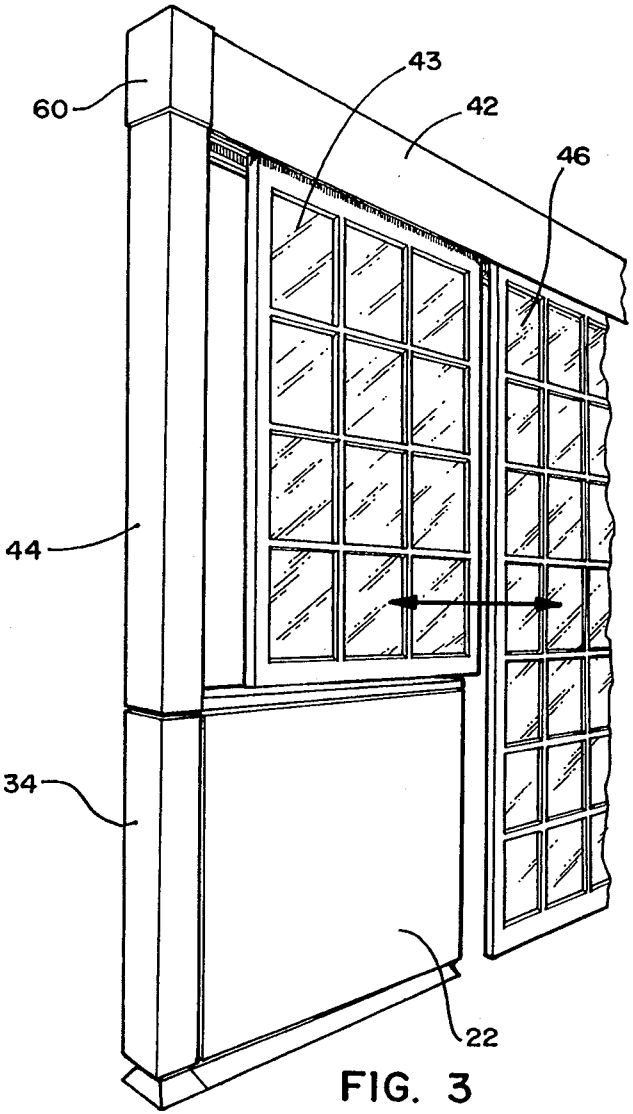
FIG. 3 is a perspective view of a sliding full door and a sliding half door or window of the present invention.

A full door 46 is shown mounted on a beam 42 in FIG. 3. A half door 48 is shown adjacent the full door. The half door is slidably mounted over a wall section 22. An end connector 34 and wall post 44 support an end of beam 42. A cover 60 fits over the junction between the wall post and the beam so as to cover the fasteners by which the two are connected.

Figure 4:
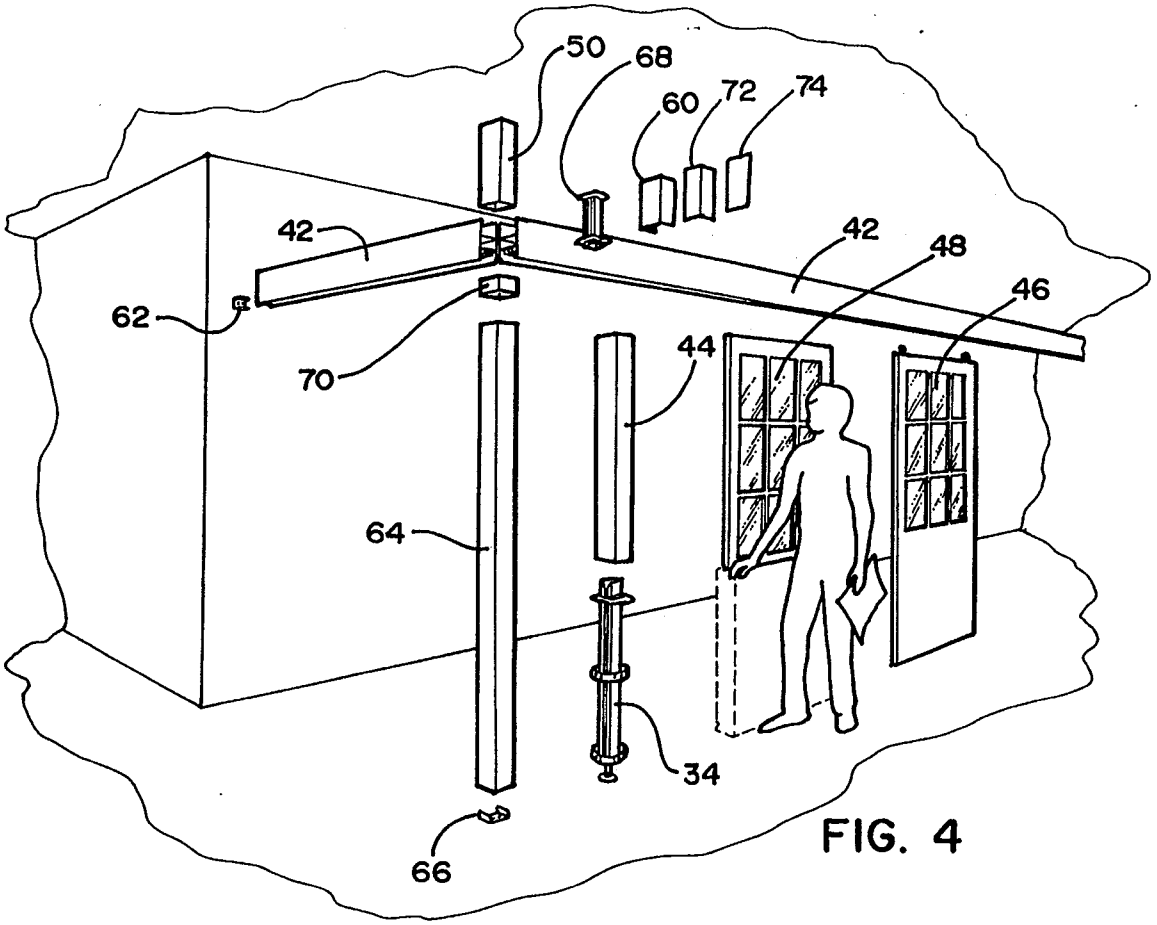
FIG. 4 is a perspective, exploded view showing various components of the post and beam construction of the present invention.

An exploded view of the beam and post construction components is shown in FIG. 4. The beams are attached to a wall by means of wall mounts 62. When a corner post 64 is employed, it is attached to the floor by means of a floor mount 66. Alternately, as shown in FIG. 1, a wall post support or end connector 34 may be employed, a shorter wall post 44 being mounted on the top thereof. The exterior cover of post 34 is not shown in this figure.

When the beam is attached to the ceiling, a ceiling extension support or ceiling pass through support 68 is employed. A ceiling pass through member or post extension 50 can be employed for extending the post upwardly through the ceiling for conveying electrical conduit or the like. A beam post connector 70 is employed for connecting post 64 to beam 42. U-shaped cover 60 is employed when a post appears at the end of a wall. A right angle cover 72 is employed at a right angle corner, as shown in FIG. 4, while plate 74 is employed to cover the end of a Tee connection.

Figure 5:
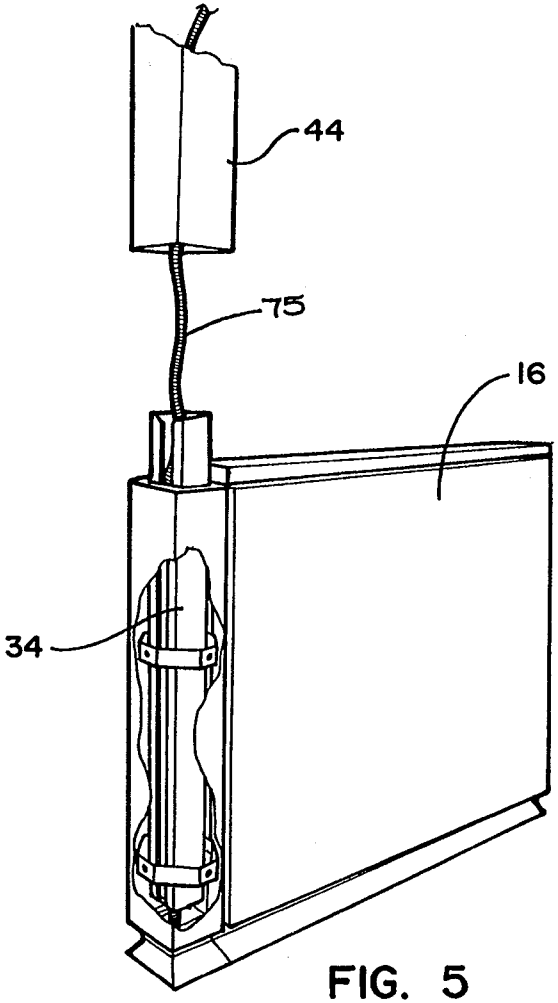
FIG. 5 is a perspective, exploded view showing a wall section and wall post support.

A wall post support member 34 is shown mounted to a lower section of wall 16 in FIG. 5. In this figure, wall post 44 is shown raised above its normal resting position on the top of post 34 in order to show the manner in which a conduit 75 extends upwardly through the floor support and the wall post mounted on top.

Figure 6:
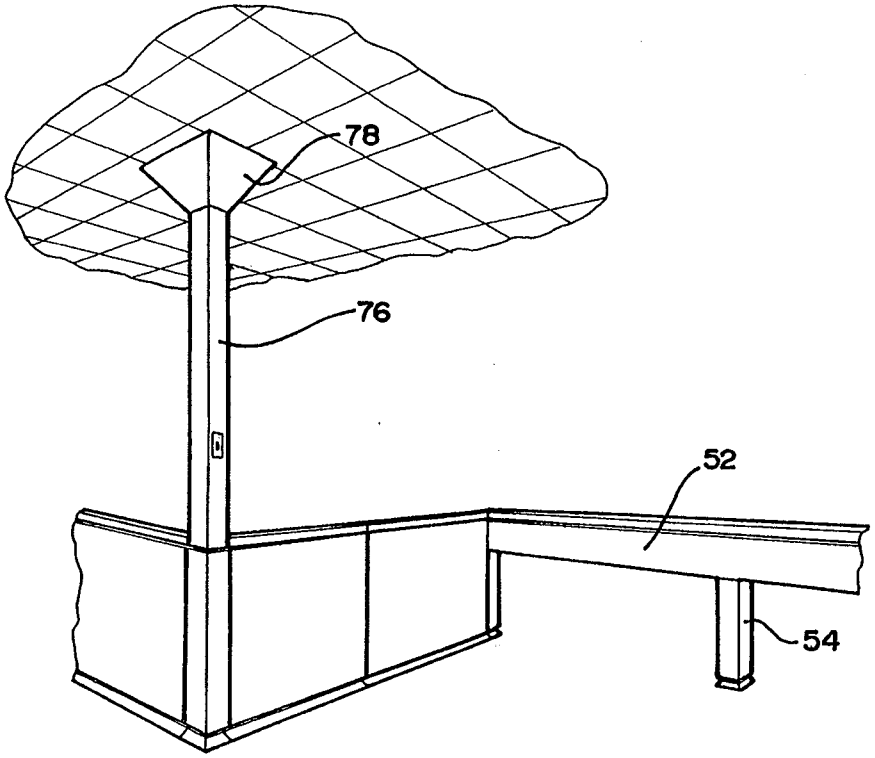
FIG. 6 is a perspective view showing a short post and beam construction forming a railing and a post construction with light fixture.

FIG. 6 shows a different type of post assembly 76 having a light 78 mounted on the top thereof. This corner fixture could also be a sign post, clock, piece of art or the like.

Figure 7:
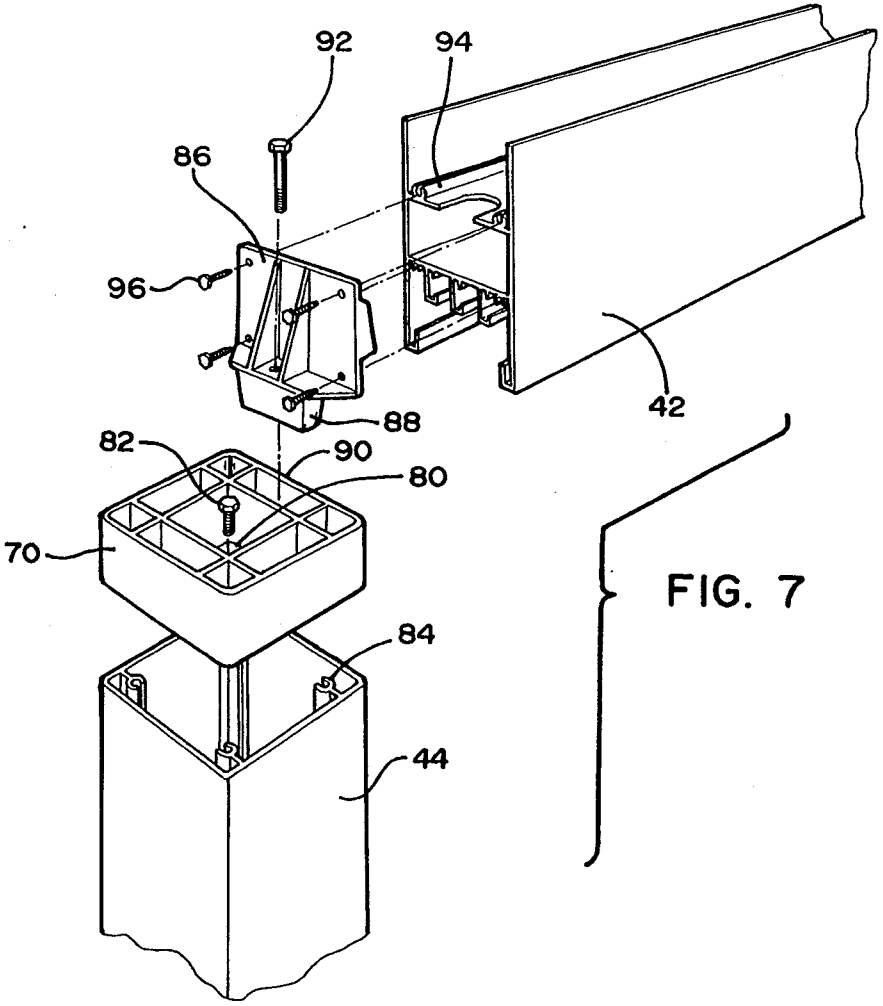
FIG. 7 is an exploded, perspective view showing the manner in which a beam is connected to a post.
Figure 8:
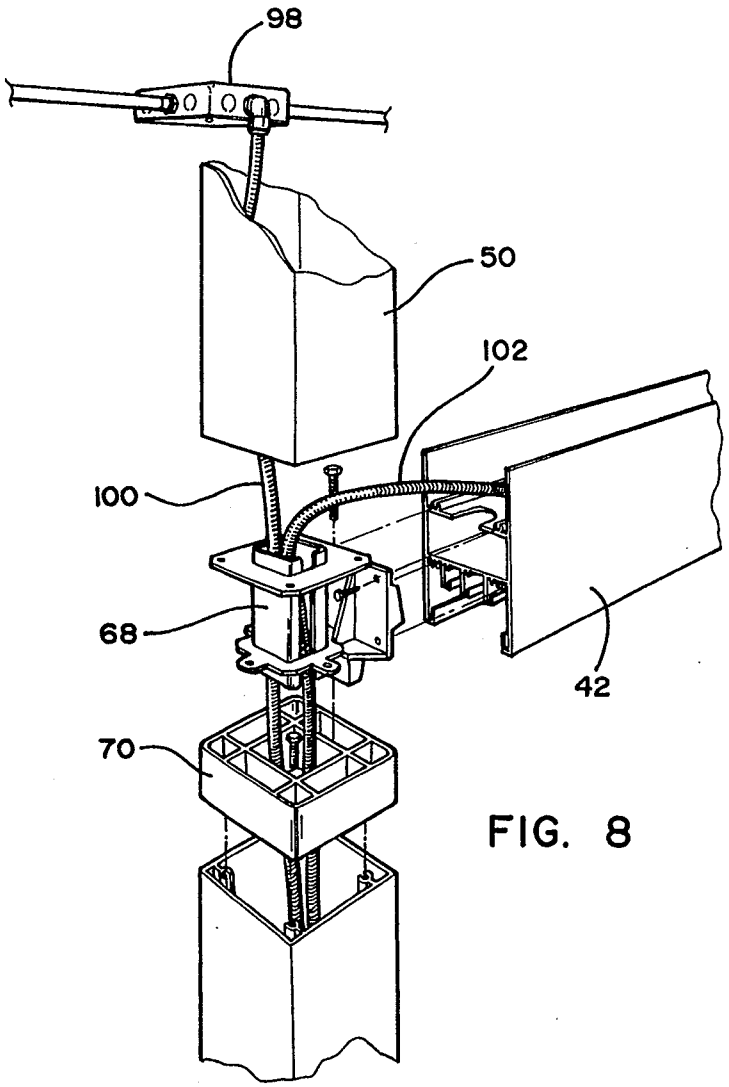
FIG. 8 is an exploded, perspective view similar to FIG. 7 showing the electrical connections extending from the ceiling and from the floor through the post and into the beam.

The manner in which the beams are mounted on posts is shown in FIG. 7 and 8. The beam-post connector 70 is square and has an opening 80 through the center leading to the interior of post 44. It is fastened on the top of the post by means of fasteners 82 which are received in appropriate retainers 84 extruded integrally in post 44. Mounting plate 86 has a lower portion 88 extending downwardly therefrom that fits in a mating opening 90 in beam-post connector 70 and is fastened therein by bolt 92. The mounting plate is attached in retainers 94 in extruded beam 42 by means of threaded fasteners 96 that extend through openings in the four corners of plate 86.

As shown in FIG. 8, when the post is extended through the ceiling in order to reach an electrical outlet 98 or the like, a ceiling extension support 68 is mounted on the top of beam-post connector 70, and the ceiling extension support is enclosed by rectangular post extension 50. Electrical conduit 100 may extend from electrical outlet 98 downwardly through the pole to electrical distribution below. Also, electrical conduit 102 may extend between the interior of the pole and the upper surface of the beam, which can serve as a raceway for electrical conduit.

The construction of the beam 42 is shown in more detail in FIGS. 9–14. Beam 42 is an extruded member formed in the shape of an "H" with two vertically spaced cross bars. Vertical sides 104 of the beam are thus connected together by an upper cross bar 106 and a lower cross bar 108. The lower edges of sides 104 are provided with upwardly turned flanges 110.

Figure 9:
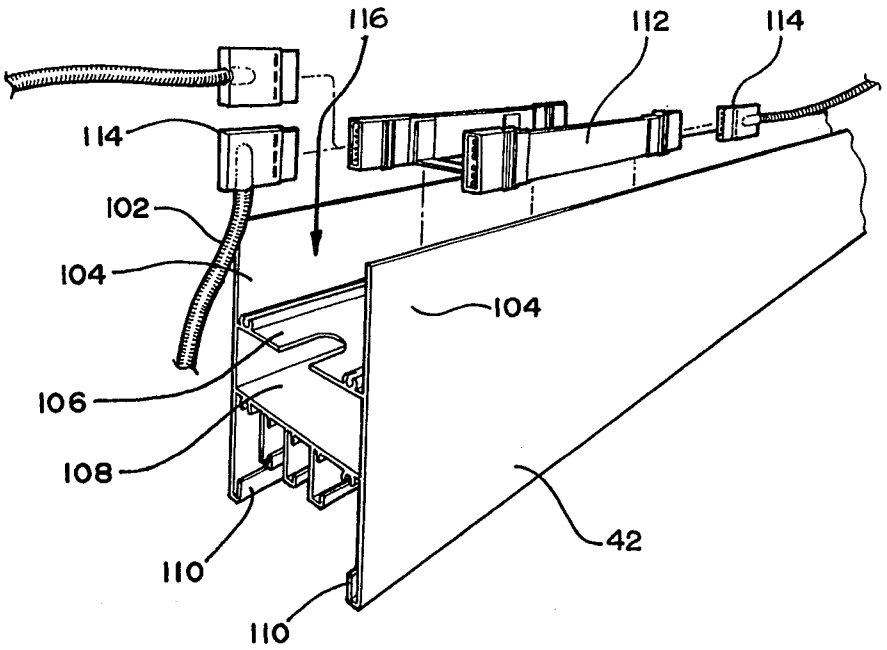
FIG. 9 is a perspective view showing typical electrical connections in the beam construction.

As shown in FIG. 9, the upper surface of beam 42 constitutes a recess 116 with an open top. One use for this recess is to run electrical conduit. Conventional connectors 112 can be employed to interconnect separate components of conduit by means of mating connectors 114 on the ends of the conduits. This construction is conventional. These electrical components can be mounted in the recess 116 in the top of the beam.

Figure 12:
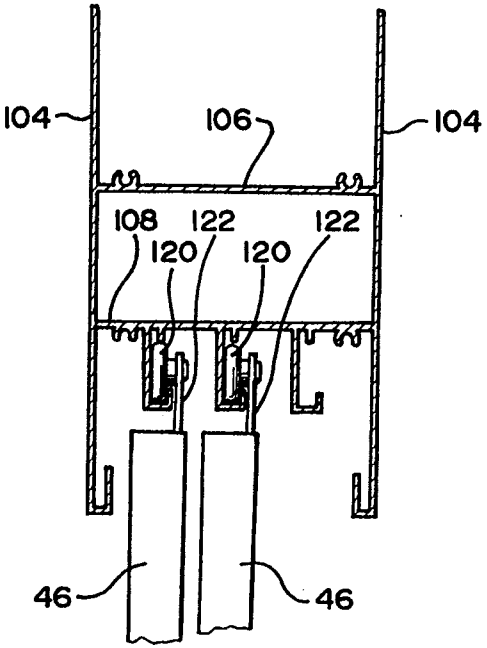
FIG. 12 is a cross-sectional view of the beam showing the attachment of a sliding door to the beam.
Figure 15:
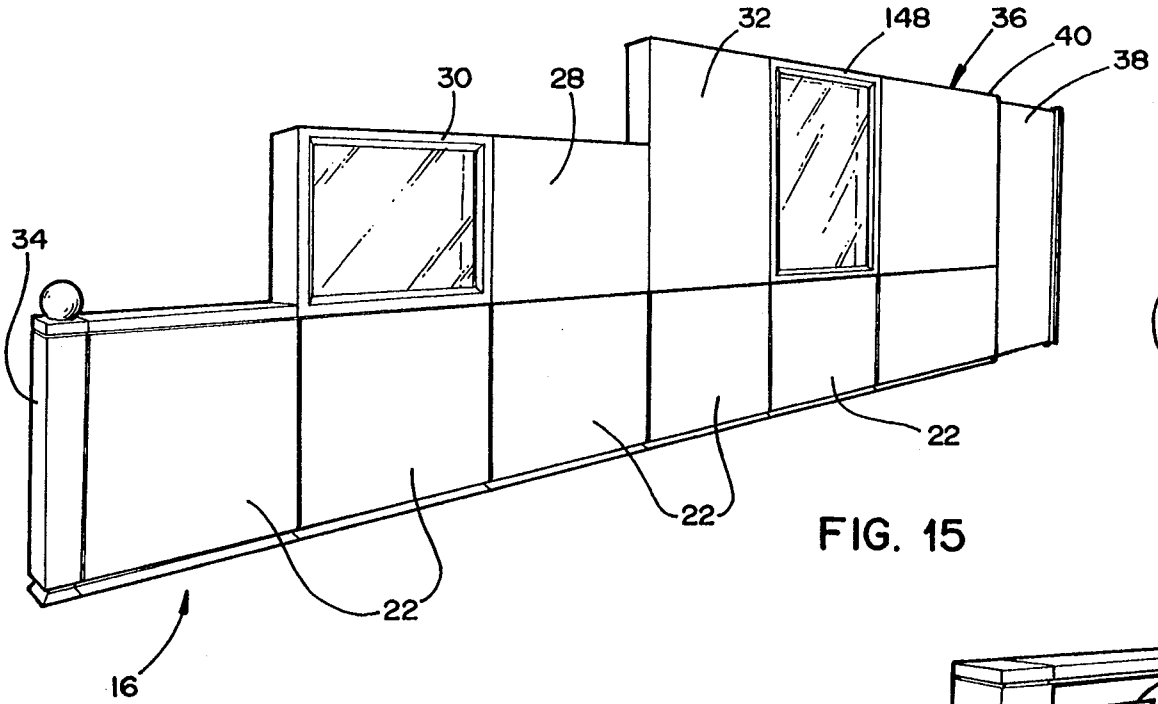
FIG. 15 is a perspective view showing a typical free standing wall construction in accordance with the present invention.

On the underside of lower cross bar 108, three J-shaped rails 118 are mounted. As shown in FIG. 12, doors 46 can be suspended in these rails by means of rollers 120 mounted on brackets 122 at the tops of the doors. The doors are mounted in separate rails so that they will slide by each other to open and close the door.

Figure 11:
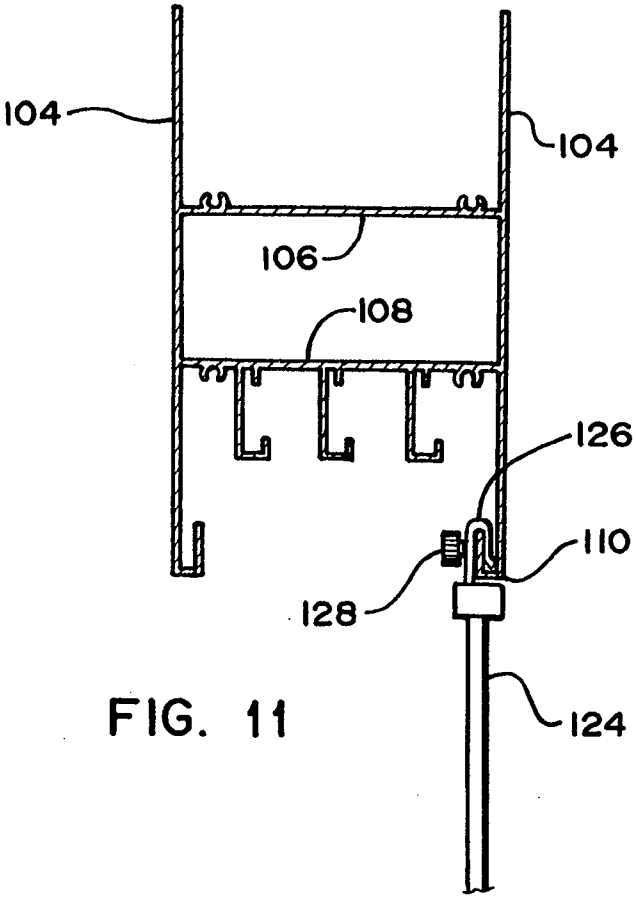
FIG. 11 is a cross-sectional view of the beam showing signage attached to the beam.
Figure 10:
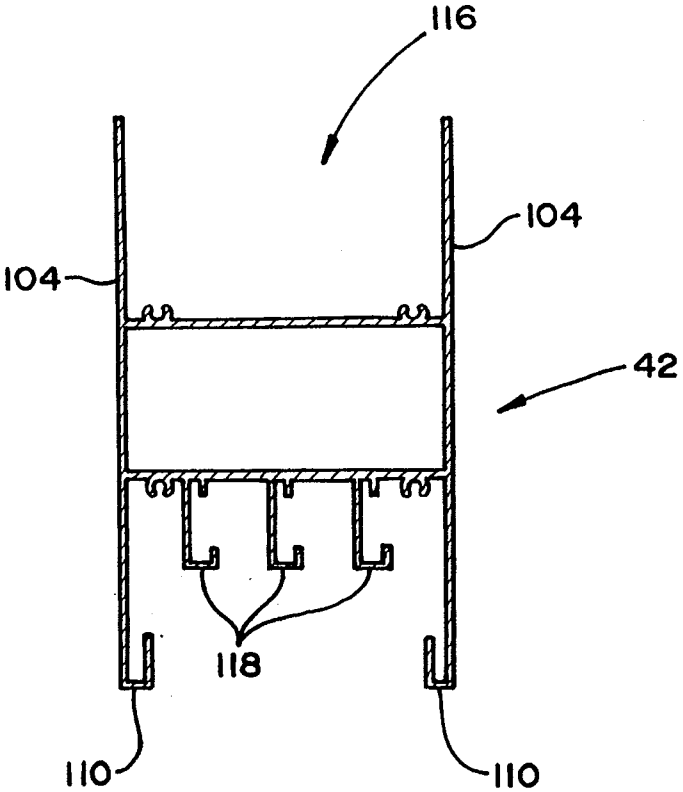
FIG. 10 is a cross-sectional view of the beam of the present invention.

As shown in FIG. 11, a sign 124 can be mounted on flange 110 by means of a mating downwardly facing U-shaped flange 126. A thumb screw 128 can be employed to lock the flanges together at a desired location.

Figure 14:
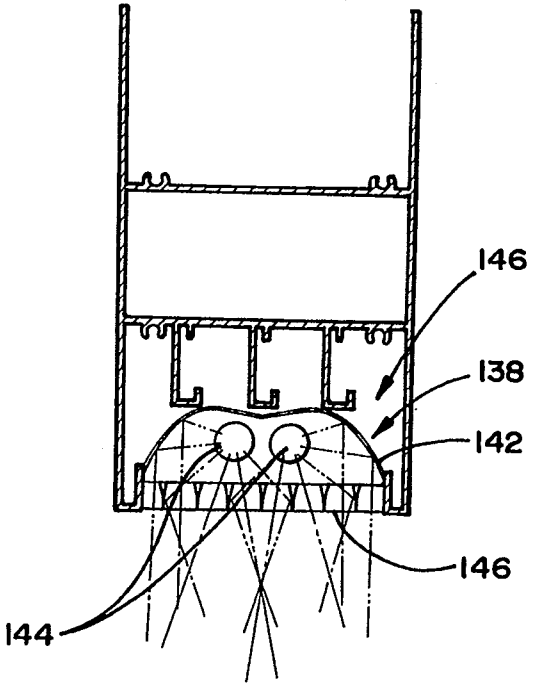
FIG. 14 is a cross-sectional view of the beam showing the incorporation of lighting in the underside of the beam.
Figure 13:
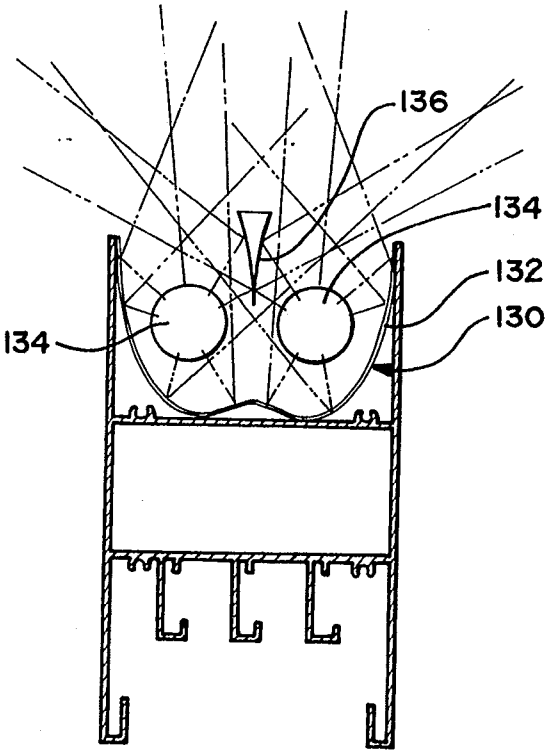
FIG. 13 is a cross-sectional view of the beam showing ceiling lighting incorporated into the beam.

Upper receptacle 116 can also be employed to house a ceiling light 130. This can consist of an upwardly facing reflector 132 and a pair of florescent lights 134 and a deflector 136, causing the light to be deflected in the manner shown. A similar light 138 can be mounted in the recess 140 on the underside of the beam (FIG. 14). Light 138 comprises a reflector 142, a pair of parallel florescent lights 144, and a diffusion grating 146.

The archistructure beam thus serves to support suspended elements, to provide upward and downward lighting and to serve as a raceway for electrical conduit. The function as a raceway is particularly important when there is a break in the lower panels, such as a doorway. With the break in the lower panel, there is no way to pass electrical conduit across the gap without a post and beam extending over the gap.

The novel modular wall construction 16 of the present invention is shown in FIGS. 15–27. Aesthetically, the wall sections appear substantially different from conventional thin open plan partitions. The wall section of the present invention is the same width or thickness (the terms are used interchangeably herein) as a conventional wall, which is about four and five-eighths ($4\frac{5}{8}$) inches thick. The wall thus conveys a thick, sturdy impression. The walls of the present invention comprise two separate components, a plurality of uniform interconnected lower wall sections 22 and a variety of optional components mounted on the lower wall sections. The lower wall sections are designed to be load-supporting to the extent that components can be mounted on top of them. They are not, however, designed to support loads in cantilevered fashion off the side of the wall panels, contrary to most conventional partition systems. The upper wall sections, on the other hand, are completely non-load bearing and may be made of light materials, such as Styrofoam or the like, which provide an appearance of thickness and height and yet are very light. The window components 30 and 148 may be of conventional construction or can be open frames. A pocket door 36 as described above can be attached to one end of the wall system.

Figure 16:
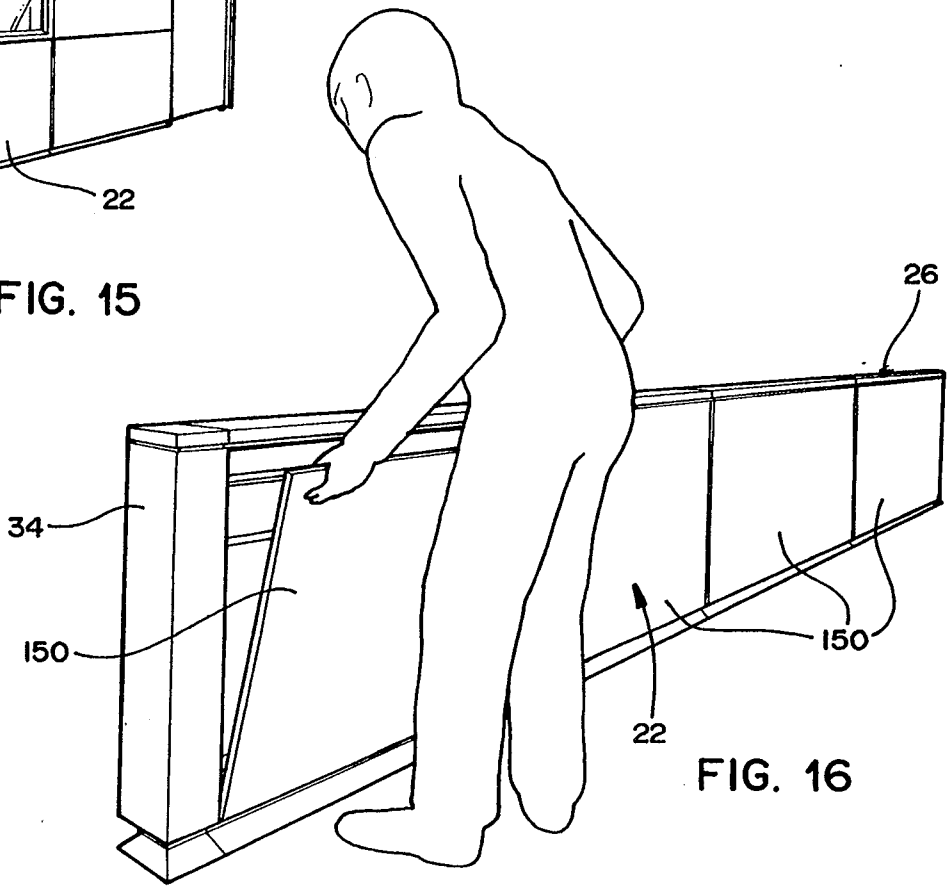
FIG. 16 is a pictorial perspective view showing the removal of a wall cover from the side of one wall section.
Figure 17:
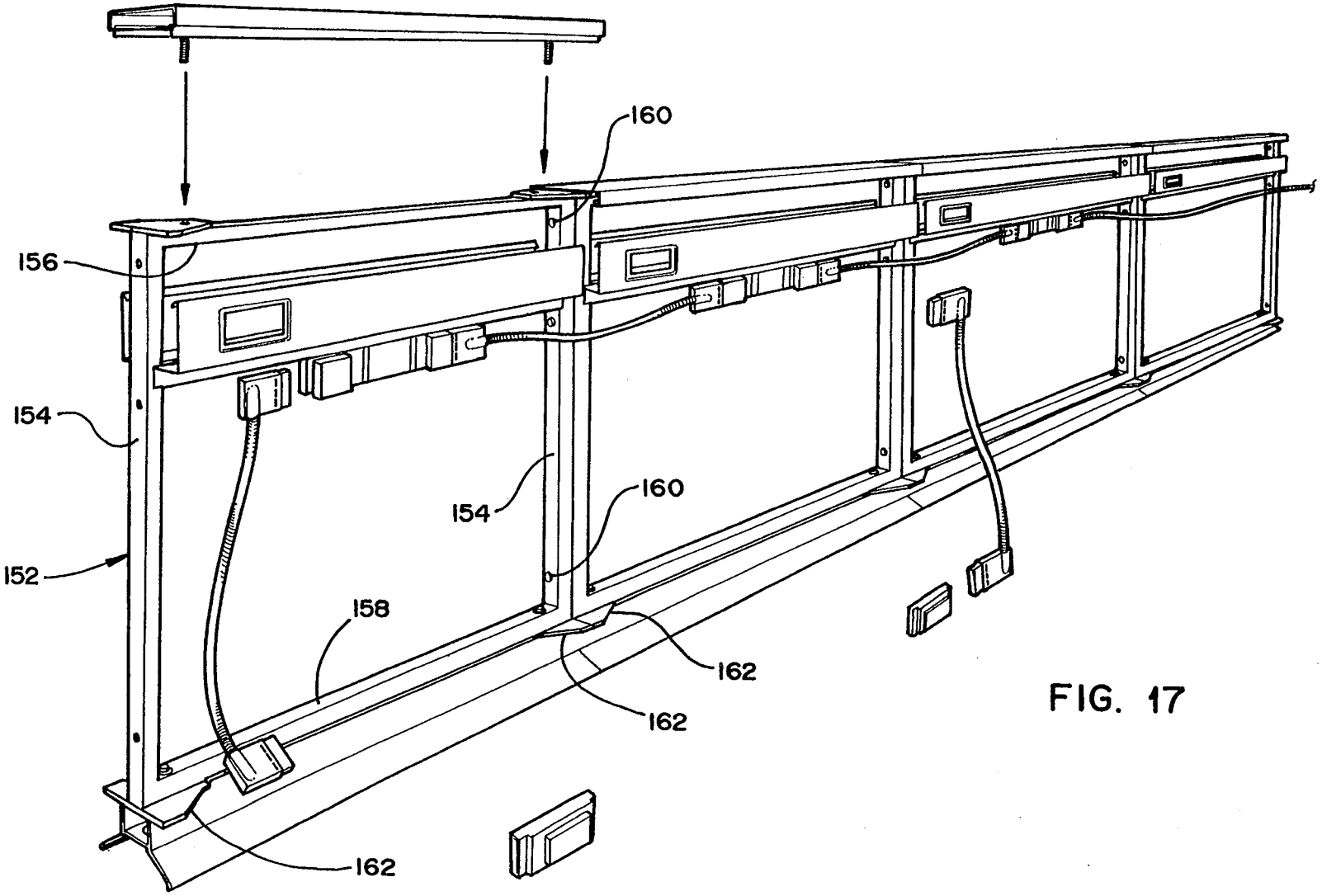
FIG. 17 is a perspective view showing four interconnected wall sections with the wall covers removed.

Referring to FIG. 16, several wall sections 22 are shown connected together end to end. The sides of the wall sections are covered by removable wall covers 150. These clip easily onto the wall sections and can be removed easily to provide complete access to the interior of the wall sections. As shown in FIG. 17 where the wall covers have been removed, each wall section comprises a rectangular frame 152 consisting of a pair of spaced vertical support members 154 at opposite ends thereof and a pair of spaced horizontal beams 156 and 158 at the upper and lower sides of the frame. Adjacent sections of frame are bolted together by bolts 160. It should be noted that the frame, and particularly the vertical support members, are substantially less wide or thick than the wall itself, thus leaving a substantial gap in between the vertical support posts and the wall covers. This is quite important to the wire handling advantages of the present invention.

Figure 27:
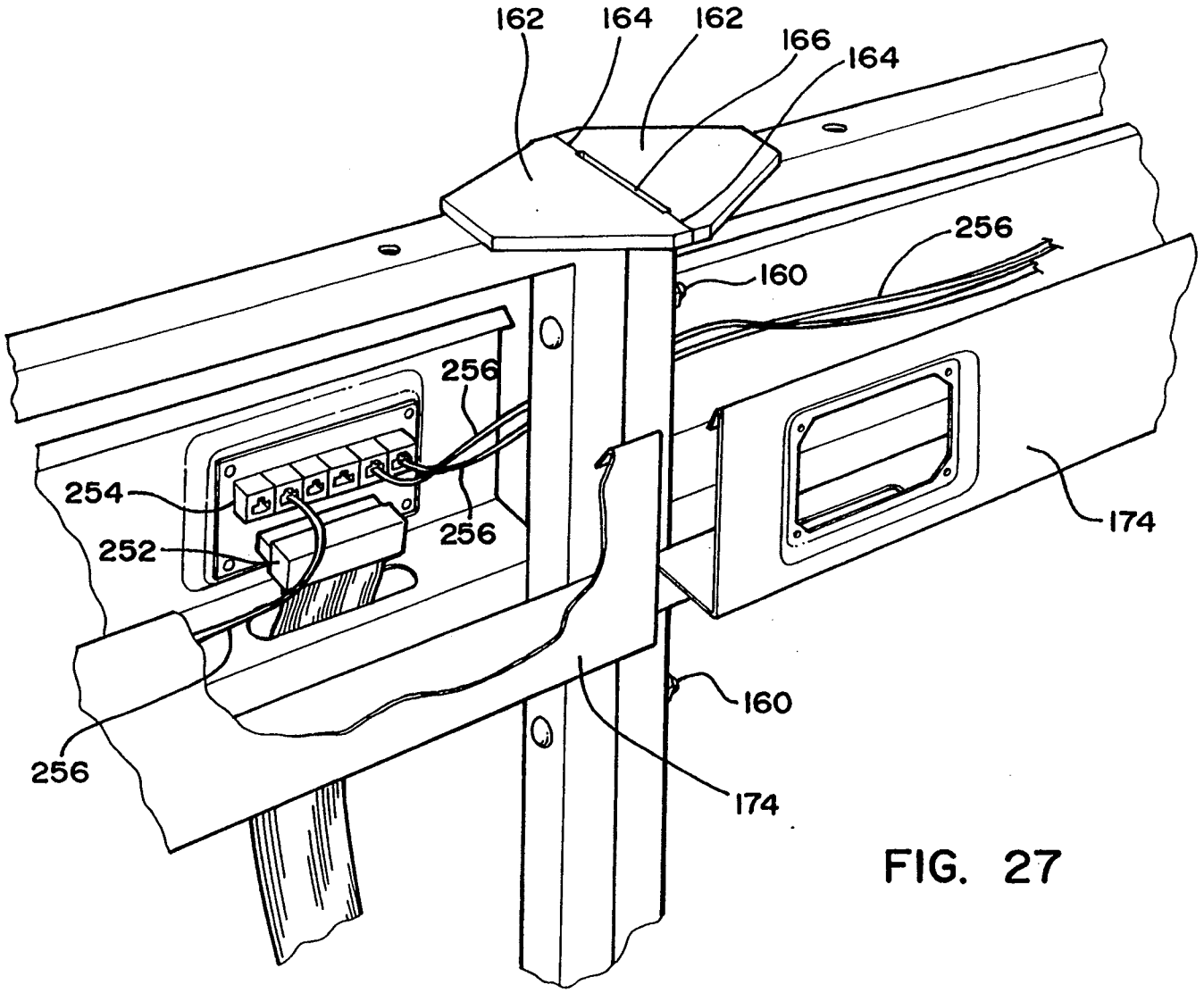
FIG. 27 is a perspective view, partially broken away, showing the manner in which the flat wire cable is connected into the communication wiring of the present invention.

On the upper and lower portions of each end of the frame, outwardly extending plates 162 are mounted. These plates serve an important function. As shown in FIG. 27, when two sections of frame are bolted together ends 164 of the plates come into contact with each other and cause the two sections of frame to be maintained in alignment. A gap 166 is provided between the ends of the plates so that the plates are held in fixed position with respect to each other.

Figure 20:
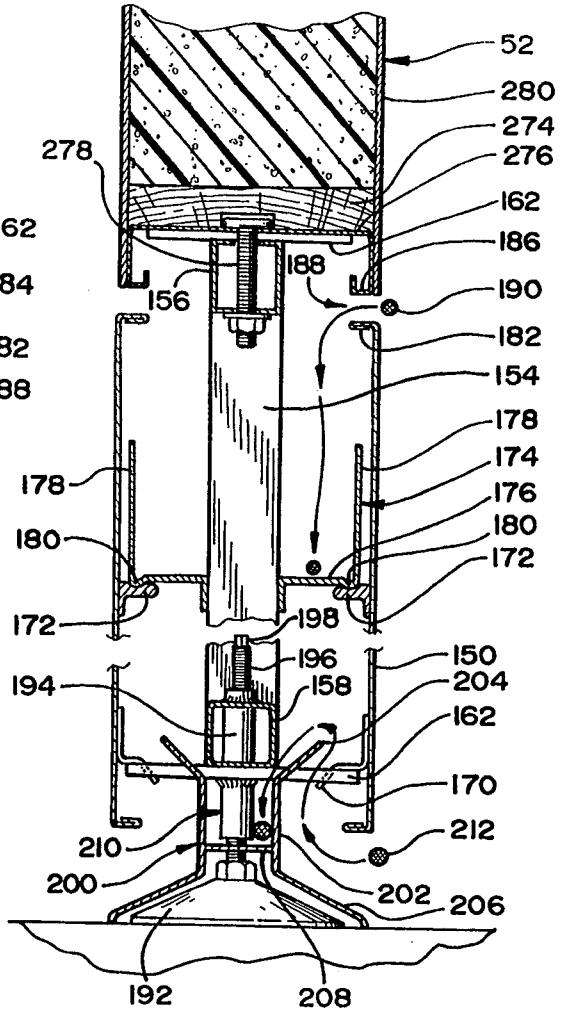
FIG. 20 is a cross-sectional view showing a wall panel of the present invention with a wall top mounted on the wall panel.

As shown in FIG. 20, plates 162 also serve as a widened support flange for the top cap and top wall section mounted on the lower section.

The lower plate 162 also supports wall cover 150. A downwardly extending lip on a flange 170 attached to the wall cover fits within an opening in the lower plate 162 and the flange rests on 162, supporting wall cover 150. The wall cover thus can be pivoted outwardly and inwardly from the top edge around the pivotal connection of flange 170 and the opening in plate 162.

The upper portion of cover 150 is held in a vertical position by means of a resilient clip 172 attached to the inner surface of the wall cover at a position substantially above the bottom. This clip resiliently engages the underside of the inner side of a wire tray or trough 174, which is in turn mounted in the frame and extends between the vertical support members 154.

Wire tray 174 has a partially closed bottom 176 and sides 178 but has an open top and open ends. The tray extends outwardly to the sides substantially beyond the vertical support members 154 (which preferably are $1\frac{1}{4}$ inch tubing) such that sides 178 are adjacent the inner surfaces of wall covers 150. Clips 172 engage the outer edge of the wire tray, preferably at the bottom, by means of projections 180 or the like on the wire tray or other such conventional resilient connection.

The wire tray is for communications wires and is metallic so that it shields the communications wires from the power wires which are mounted below the wire tray.

Figure 19:
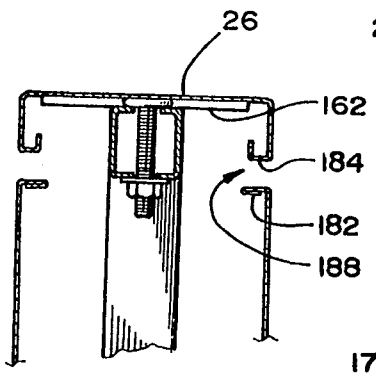
FIG. 19 is a cross-sectional view showing the manner in which a top cap is mounted on the wall panel of the present invention.

As shown in FIGS. 19 and 20, the upper end 182 of wall cover 150 is spaced below the lower edge 184 of top cap 26 or lower edge 186 of wall top 32. This makes it possible for communications wires 190 to be inserted into the interior of the wall sections in a sideways direction through a slot 188 between the top cap or wall top and the top of the wall cover. The wiring will then fall down into the wire tray and be retained there.

This provides an extremely important advantage for the present invention. As shown, when it is desired to string a new communications wire along an entire length of wall through a number of interconnected wall sections, all one has to do is stuff the wire sideways through slot 188 in the adjoining wall sections and the wire will naturally fall into its proper position in the wire tray. There is no need to remove the wall covers and no need to string the wire through any frame openings. The wall can thus accommodate wide variation and frequent changes in communications (typically computer and telephone) wiring without disassembly of the wall system.

The bottom of each wall section is supported on the ground at each end by means of a wide (preferably 4 inches) disc shaped feet 192 which are mounted to the lower beam 158 by means of a threaded sleeve 194 that extends through the beam and is welded thereto. A threaded shaft 196 extends upwardly from foot 192 and is received in threaded sleeve 194. The height of the wall section can be adjusted conveniently by means of a nut 198 formed on the top of shaft 196. Rotation of this nut serves to raise and lower foot 192. Nut 198 is easily accessible simply by unclipping and removing one of the wall covers 150, and it is not necessary to seek access to the adjustment mechanism in any obscure location. While the foot mechanism is basically conventional, the foot itself is quite a bit wider than normal in order to provide additional stability for the wall system and to permit a wall section to stand on its own or to be fastened to the floor structure through provided holes. The adjustment provides a vertical travel of one and one-half ($1\frac{1}{2}$) inches desirably so as to provide a wall height of a minimum of one (1) inch from the floor and a maximum of about two and one-half ($2\frac{1}{2}$) inches from the floor.

At the underside of the wall panel and resting on the floor is a power cable chase 200. This power cable chase runs the entire length of each wall section and continuous contiguously from wall section to wall section. Chase 200 includes vertical side walls 202, upper flanges 204 attached to the top of the side walls and flaring outwardly, and lower flanges 206 attached to the lower edges of the side walls and extending outwardly to lower ends that contact the floor. A central web 208 extends horizontally between side walls 202. The chase thus presents an open top receptacle 210 between the opposite sides of the chase. This receptacle serves as a chase or support tray for power cables 212. The outwardly flared lower flanges 206 extend over feet 192 and conceal them from view, as well as concealing the other mechanical hardware on the underside of the wall sections.

As shown in FIG. 20, power cables 212 can be easily inserted into power chase 200 with the walls in place simply by threading the power cables sideways over the edge of flange 204 and allowing the power cables to drop into receptacle 210. While it appears from FIG. 20 that plate 162 would interfere with the passage of the wire downwardly into the receptacle, by reference to FIGS. 24 or 25 it can be seen that the upper edge of flange 204 is recessed at the point where it intersects plate 162. Wires can thus be laid on top of the plate or can be threaded under the plate through the recess in the flange at the ends of each wall sections.

Figure 22:
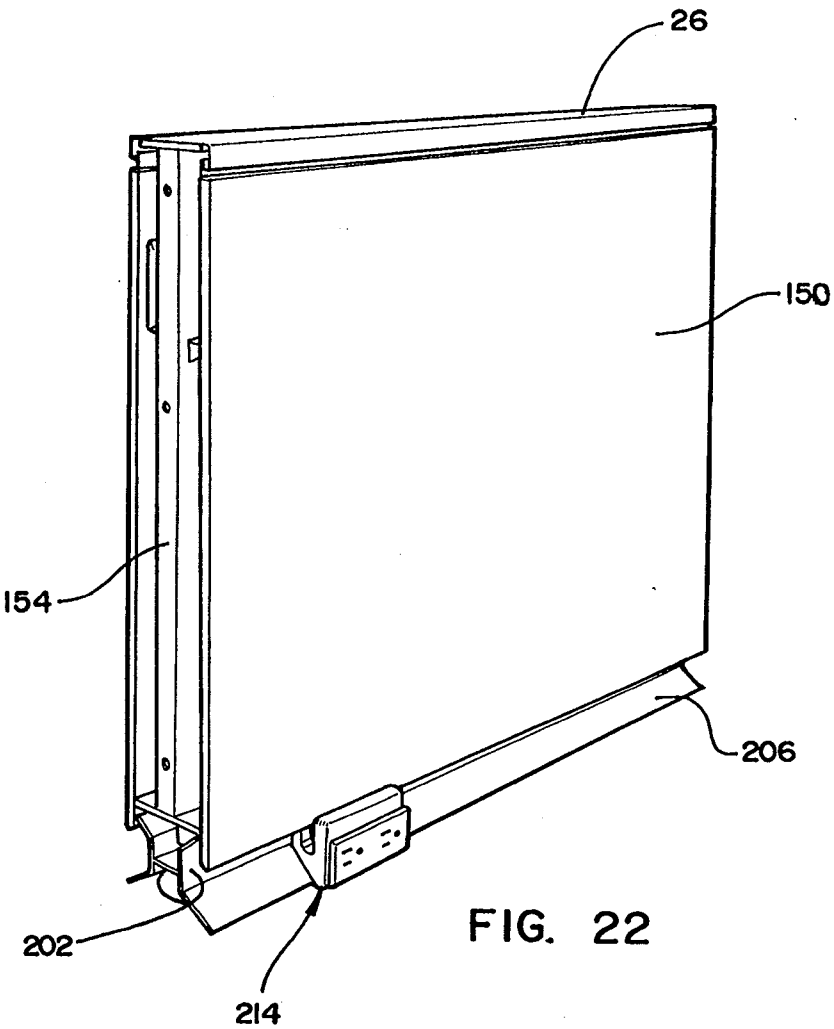
FIG. 22 is a perspective view showing a wall panel with an electrical outlet mounted on the bottom thereof.
Figure 21:
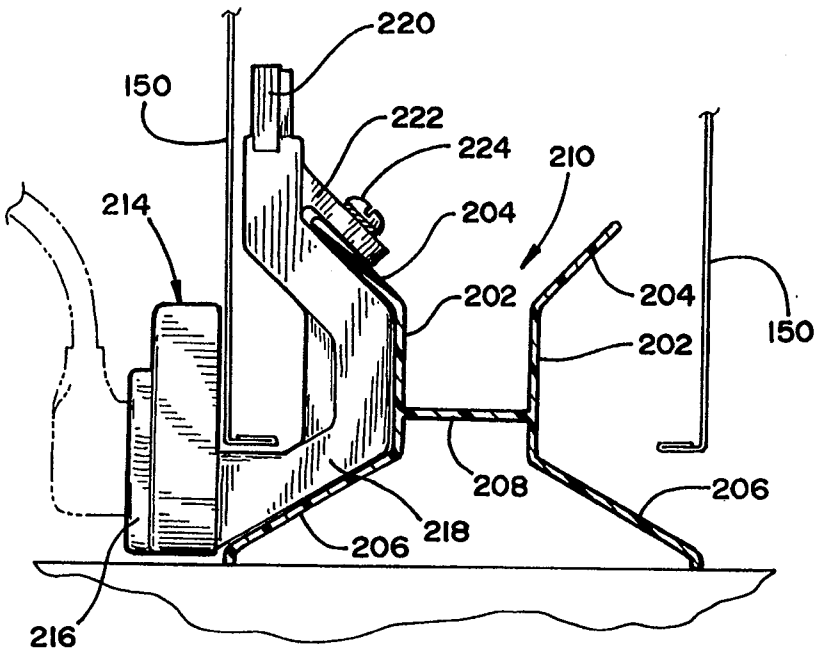
FIG. 21 is a broken cross-sectional view showing the power routing and access means at the bottom of the wall panel.

FIGS. 21 and 22 show how the power chase can be used as a means for connecting electrical outlets at any desired position along the power chase. An electrical outlet assembly 214 comprises a plug receptacle 216 that is positioned vertically at the lower end of wall cover 150. The wall outlet assembly further includes a back portion 218 extending from the lower rear of outlet 216 under the lower edge of wall cover 150 upwardly and inwardly along flange 206, upwardly along flange 202, and then upwardly and outwardly along flange 204. Back portion 218 carries the electrical conduit to a terminal 220 at the top of the back portion, and this terminal is connected to standard connectors for power cables. A flange 222 extends parallel to the upper portion of flange 218 on the inner side of flange 204, and a threaded lock screw 224 extends through flange 222 to clamp the receptacle assembly at any desired longitudinal position along the power chase. As shown in FIG. 22, by loosening lock screw 224, the receptacle can be slid from one end to the other of the wall section as desired and then locked into place.

Figure 24:
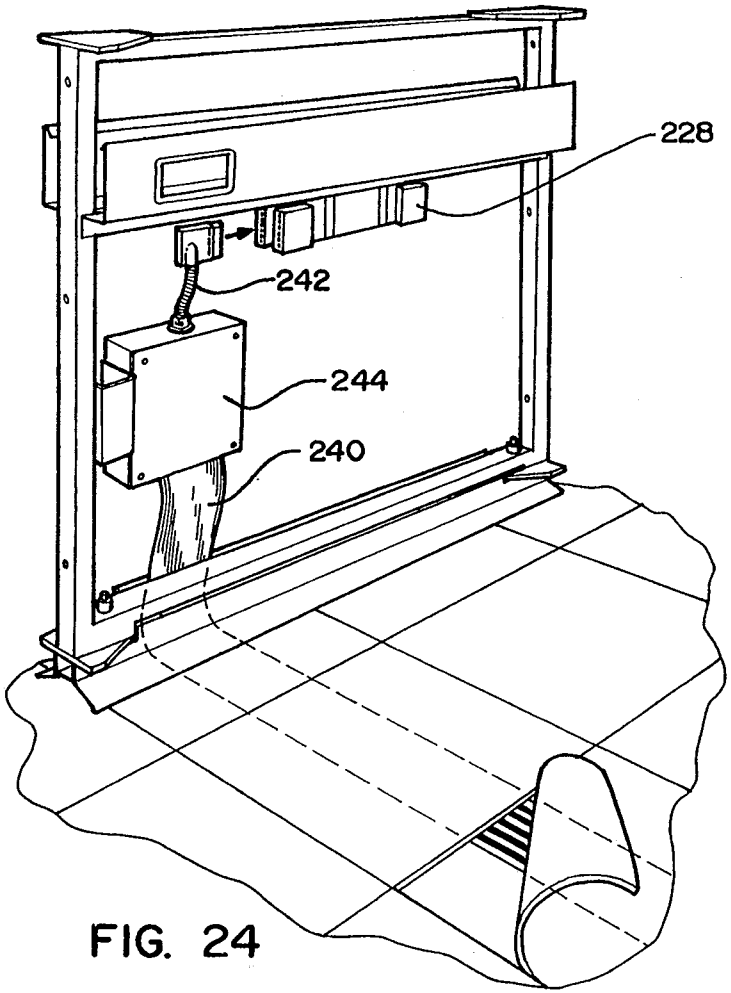
FIG. 24 is a perspective view showing the frame and power fixtures of the present invention mounted with an under carpet flat power cable.
Figure 23:
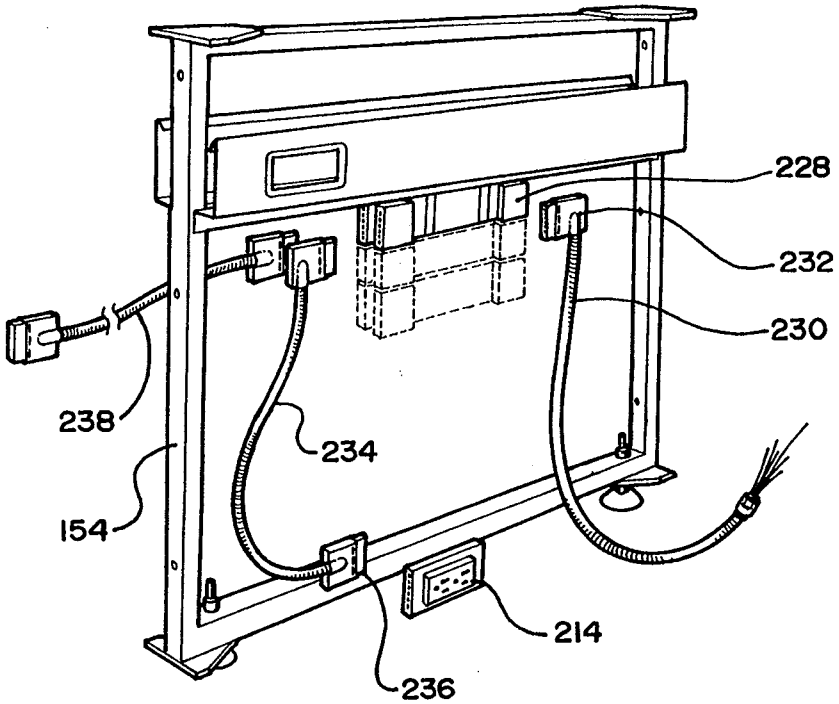
FIG. 23 is a perspective view showing the frame and electrical power fixtures of the wall panel.
Figure 25:
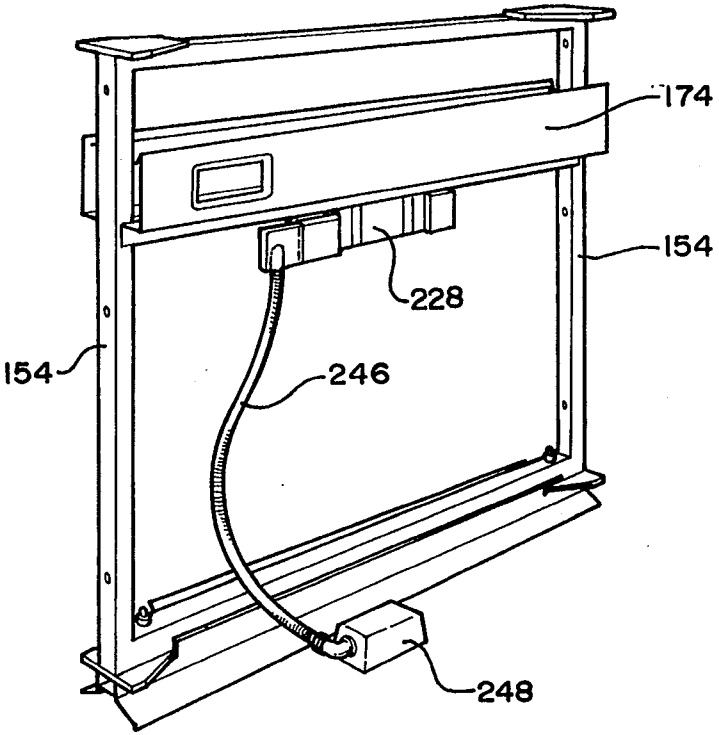
FIG. 25 is a perspective view similar to FIG. 24 showing a floor power monument.

FIGS. 23, 24, and 25 are similar and show the manner in which the wall sections can be wired into electrical power. In FIG. 23, conventional connectors 228 are suspended from the underside of wire tray 174. Any number of connectors (shown in phantom) can be connected together to form two, four, six, eight or more power terminals. Cable 230 is an illustrative inlet or infeed cable leading from a floor or wall monument to a connector 232 which connects to one of the terminals of connector 228. One outlet cable 234 can extend downwardly to a connector 236 leading to a desk or to a face mounted outlet 214 of the type shown in FIG. 21. Another outlet conduit 238 extends in the generous space between the wall cover and relatively narrow vertical support member 154 directly into the next wall section where it interconnects with another connector 228. With the standard connectors, individual wall sections can easily be wired together with any number of power cables simply by plugging plugs in after unclipping the wall covers. Nothing has to be threaded through any opening in any support members and all the cables can be inserted sideways into the walls. This considerably facilitates installation.

FIG. 24 shows a means by which power can be obtained from an under carpet flat cable 240. A cable 242 connected to connector 228 leads to a terminal box 234 which in turn electrically connects under carpet flat cable with cable 242.

FIG. 25 shows the manner in which a cable 246 can be connected to a source of power from a floor monument 248.

Figure 26:
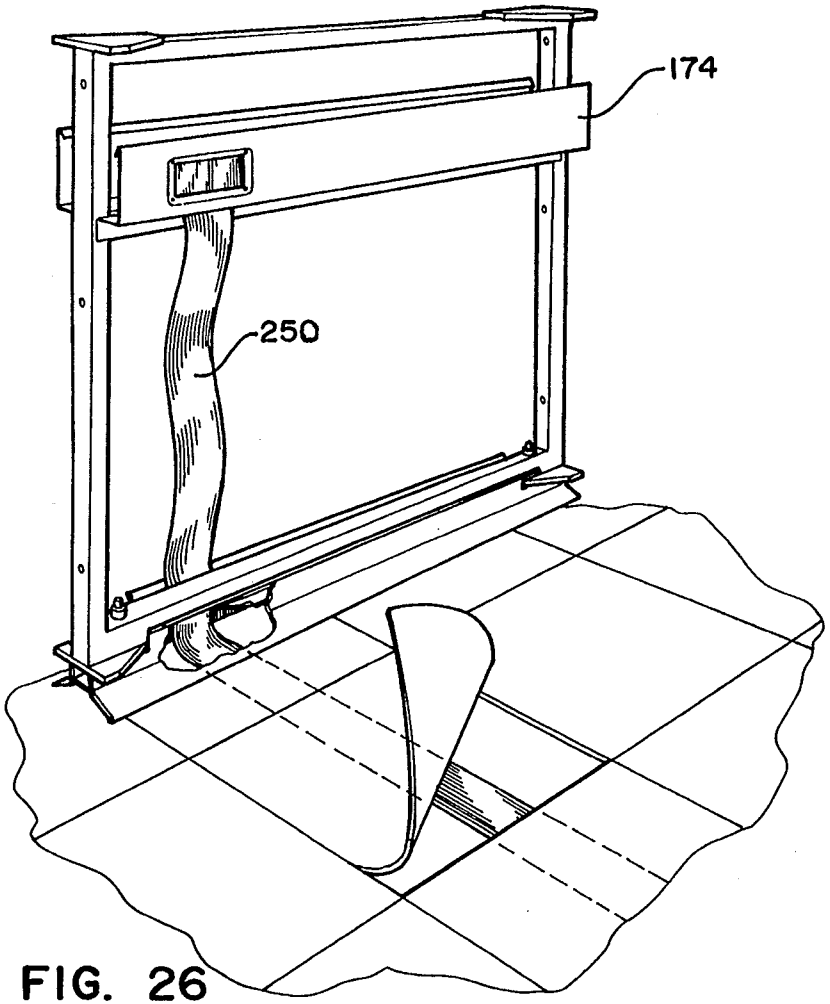
FIG. 26 is a perspective view similar to FIG. 25 showing a flat wire cable hookup to the communication wiring in the panel system.

FIG. 26 shows the manner in which communications wiring, such as telephone wiring, can be connected to the wire tray 174. A typical twenty-five (25) pair flat wire cable 250 extending from under a carpet feeds upwardly into the wire tray. As shown in FIG. 7, a terminal connector 252 connects to a bus mechanism 254 into which individual telephone lines 256 can be plugged. Phones can be connected and disconnected easily by removing the wall cover and simply reaching in and plugging in or unplugging the phone. Any other type of conventional telephone wiring system or computer wiring system also would be compatible with this system.

Figure 18:
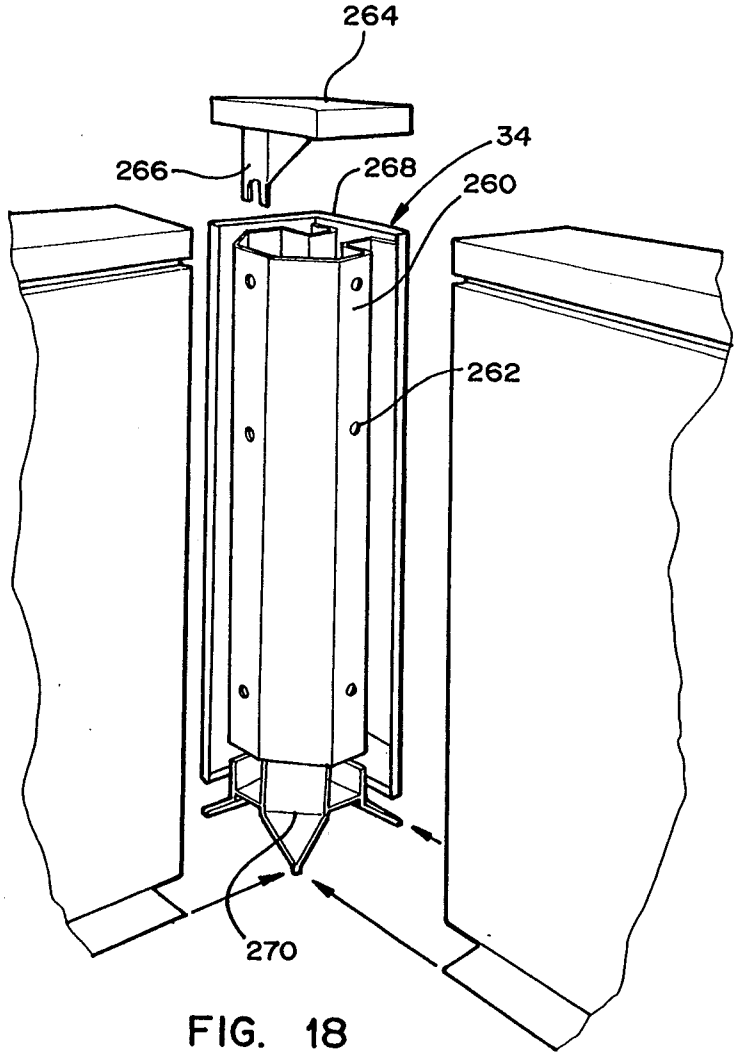
FIG. 18 is an exploded, perspective view showing a pair of wall sections connected at right angles by a wall connector.

The corner post mechanism 34 attached to the ends of individual wall sections is shown in FIG. 18 with reference to an exemplary right angle connection. The corner post mechanism comprises a metal column 260 having flat sides with openings 262 therein facing the ends of the wall sections. The end column is bolted to the ends of the wall sections through these openings 262. A top cap 264 fits downwardly on the top of the end connector, with a downwardly extending flange 266 serving to attach the top to the connector by means of one of the bolts attaching the connector to the end of the wall section. An appropriate cover 268 (which is a right angle cover in FIG. 18) fits over the metal column 260 to enclose the column. The cover could have three sides if being attached to the end of a single wall section or a single side if attached to a Tee connection wherein three wall sections are interconnected. The end connector column is supported by a plurality of legs 270. The column is formed so that electrical and electronic wiring can pass from one wall section to the other through the connector, or it can extend upwardly through a connector to a post mechanism (as illustrated in FIGS. 4 and 8).

The wall tops mounted on the tops of lower wall sections 16 provide an important feature of the present invention. These wall tops can be short tops 28 or tail tops 32 or any customer specified size higher or lower. Since the wall tops function as room dividers and do not need to function to support wall hung furniture, they can be made inexpensively and yet have a variety of attractive finishes. Desirably, they are formed of a rigid foam plastic such as Styrofoam or the like formed on a rigid base formed of wood 274 or other suitable material. The base can be attached to a cap 276 similar to top cap 26 that fits over plate 162 and is bolted to beam 156 by threaded fastener 278, with each wall top section being bolted to the beam in at least two locations. The surface of the wall top can be decorated with any number of surface textures and materials. A particularly desirable material is a flocking 280 which can be sprayed on the material and gives it an expensive velour appearance at a very reasonable price.

Plate 162 stabilizes wall top 32 in a vertical position and the bolt fastener attachment holds the wall top in proper alignment with the lower wall section on which it is mounted. Because the wall top is light and non-load bearing, complex and expensive fastening and frame mechanisms are not necessary.

To install and remove wall tops or top caps, it is only necessary to unclip the wall cover and bolt or unbolt the desired fixture.

The archistructure and wall system of the present invention contemplate that the furniture will not be wall suspended but will be free standing. To this end, the present invention incorporates a series of free standing modular desks having interchangeable components that provide a wide variety of individually selectible office desk environments, without requiring special wall structures or wall modifications.

Figure 50:
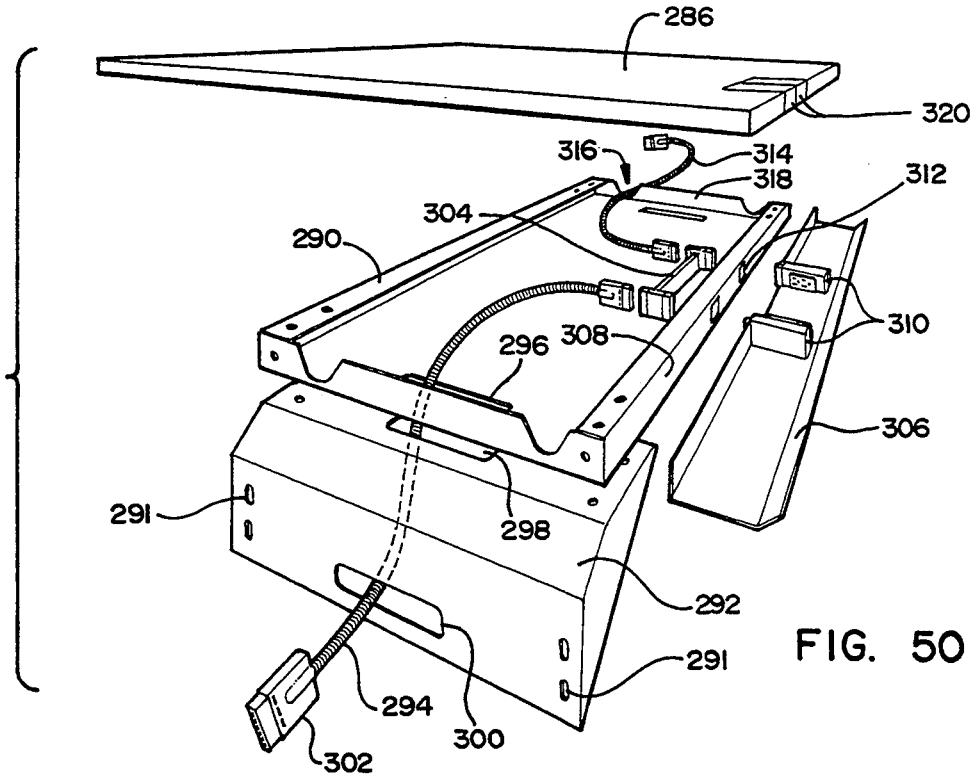
FIG. 50 is an exploded view of the desk top of the desk of the present invention showing the electrical connections in the beam support underneath the desk top.

A basic desk unit 12 is disclosed in FIGS. 28–31. The desk unit 12 comprises a pair of spaced half width pedestals 282, each having drawers 284. Files are stored longitudinally in the drawers instead of widthwise across the drawers. Each desk has a floating desk top 286, which is spaced above the pedestals and attached to the pedestals by means of a transverse support beam 290 mounted on the underside of the work top and corner braces 292 interconnecting the support beams at the ends with the pedestals 284 (see FIG. 50). The support beam and corner braces desirably are formed sheet metal members, with beam 290 comprising an open top tray that serves to house electrical components. Corner brace 292 comprises a hollow sheet metal brace having a horizontal leg attached to the corner of beam 290 and a vertical leg attached to the inside of the pedestal. The position of the vertical leg can be varied on the pedestal by slotted bolt openings 291 or the like in order to vary the height of the desk top for individual preferences. Electrical cables 294 extend through an opening 296 in the underside of beam 290 and through a mating opening 298 in brace 292 and then through an exit opening 300 in the vertical leg of brace 292. This cable then extends to a terminal Connector 302 which can be connected to an infeed source of electrical power. As with the wall sections, power can be received in any number of ways. A floor monument positioned at the bottom rear of the pedestal would be one typical way to transfer power to the desk via terminal 302 and cable 294. Power also can be delivered to the desk by one of the power cables carried by an adjacent wall section or through a post connector. As shown in FIG. 1, desk 12 abuts a wall section on one end thereof. Power cables carried in this wall section could be connected to terminal 302 in the interior of the pedestal or in the interior of the wall section.

The infeed cable 294 is connected to a terminal bus 304 of conventional design. A wire tray 306 is attached to the rear edge 308 of beam 290 and outlets 310 mounted in the trays extend through openings 312 in wall 308 and plug into bus 304. Thus, power cable 294 provides power to a pair of outlets mounted in the wire tray. Another power cable 314 can be connected to the bus and can exit the beam by means of a recess 316 in a side 318 of the beam. This power cable can lead to a computer, lighting or other electrical apparatus. All of these electrical connections can be altered easily by lifting the table top and plugging or unplugging the electrical components. Alternatively, the desk top can be provided with one or more access doors 320 for gaining access to the outlets without lifting the desk top.

Referring to FIGS. 28–31, the pedestals are desirably about seven and one-half (7½) inches wide. The back of the desk can be open or it can be covered by lower back panels 322, which are desirably about fifteen (15) inches wide. As shown, the desk top desirably extends about halfway over the pedestals so that wiring can be tucked under the edge of the desk between the pedestal and desk top. The same wiring would then run through the wire tray at the back of the desk.

Figure 49:
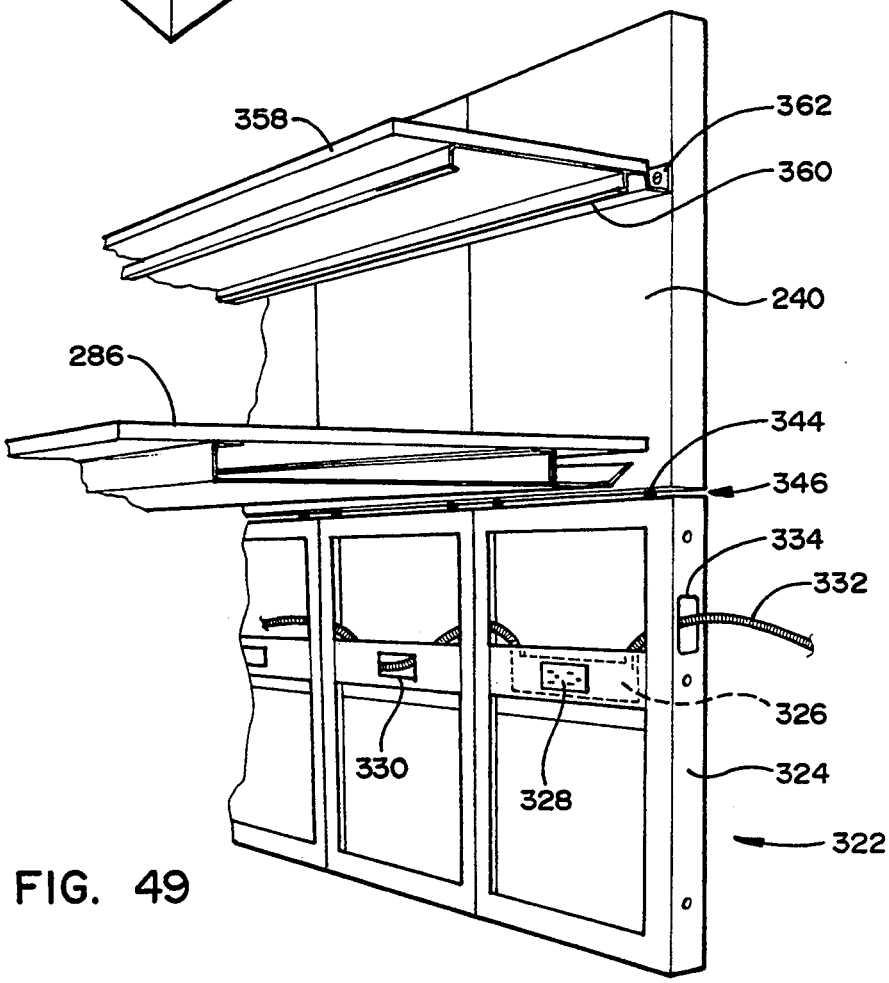
FIG. 49 is a perspective view of the underside of the desk of the present invention, showing the electrical connections of the bottom panels with their panel covers removed.

The construction of the lower bottom panels of the desk is shown in FIG. 49. Bottom panels 322 are load bearing panels and comprise a rectangular metal frame 324 preferably formed of channel material. The frame can include a transverse plate 326 in the middle thereof to support electrical outlets 328 which are mounted in openings 330. Electrical conduit 332 extends through adjacent panel sections (which are bolted together) via openings 334 in the frame. As shown in FIG. 49, electrical outlet 328 can provide electrical power to the electrically operated devices at the desk. The panels 322 can be covered with decorative covers and can use the same type of cover as employed in the wall sections, if desired.

In addition to the basic desk unit, a number of optional features can be included. As shown in FIG. 32, the desk can be provided with a privacy screen 334 which can be bolted on the top of panels 322. The privacy screen shown in FIGS. 32–35 is not intended to be a load bearing screen and therefore can be made of the same lightweight type of construction as wall tops 28 and 32. The desk panels, however, are designed to be substantially thinner than the wall panels so as to distinguish between the screens and panels used for a desk and walls.

As shown in FIG. 35, the rear edge of desk top 286 terminates short of privacy screen 334, leaving a gap 336 at the back of the desk. This permits wires to be inserted at the rear edge of the desk top so that they can be carried in wire tray 306. FIG. 34 shows a gap 338 between the desk top and pedestal so that wires can run under the sides of the desk top as well.

Figure 28:
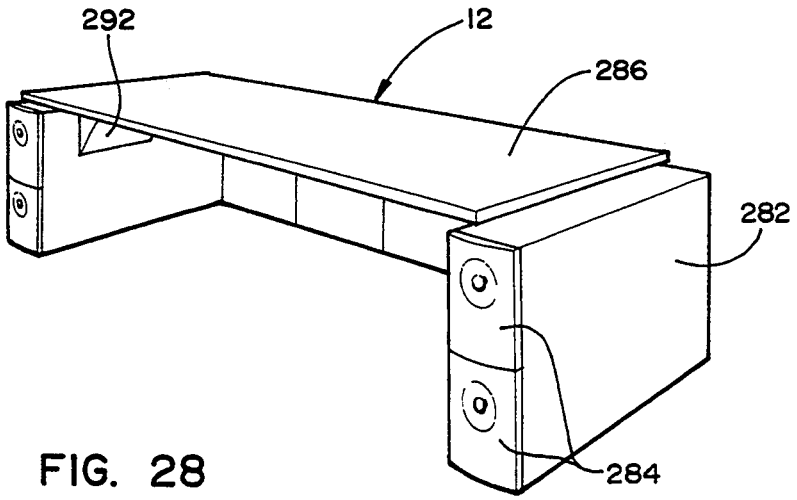
FIG. 28 is a perspective view of a desk of the present invention.
Figure 29:
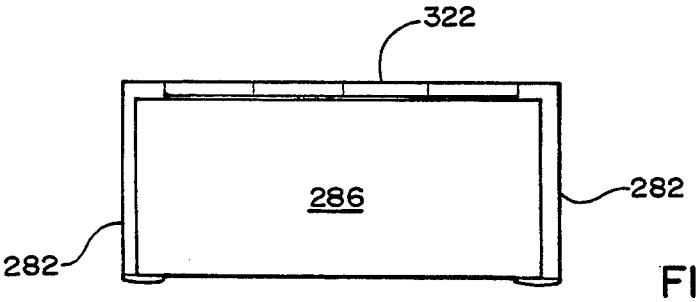
FIG. 29 is a top view of the desk of FIG. 28.
Figure 30:
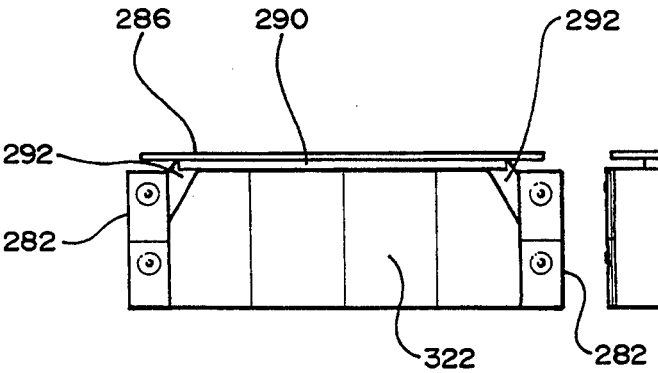
FIG. 30 is a front elevational view of the desk of FIG. 28.
Figure 31:
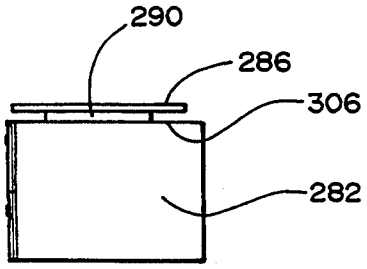
FIG. 31 is an end elevational view of the desk of FIG. 28.
Figure 36:
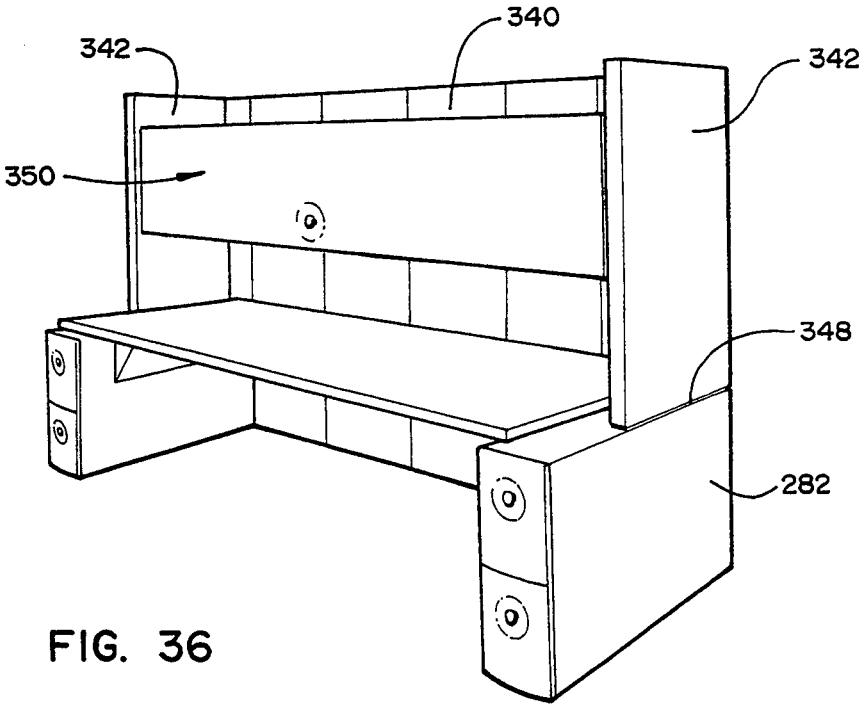
FIG. 36 is a perspective view of the desk of FIG. 28 employing tall top panels and a storage unit.
Figure 37:
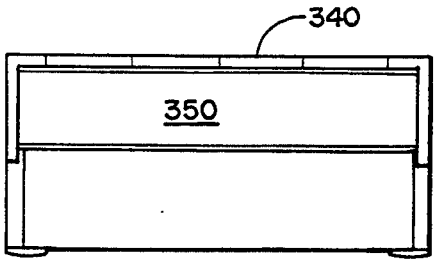
FIG. 37 is a top plan view of the desk of FIG. 36.
Figure 38:
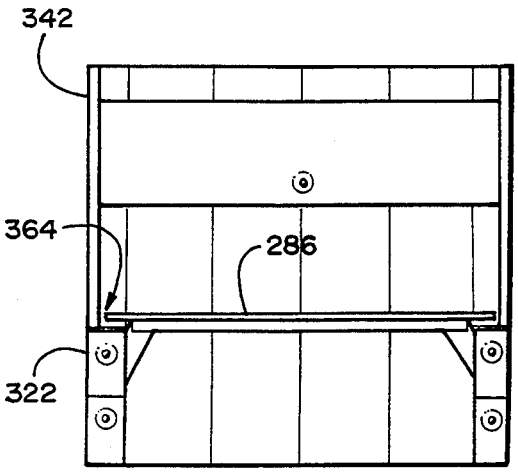
FIG. 38 is a front plan view of the desk of FIG. 36.
Figure 39:
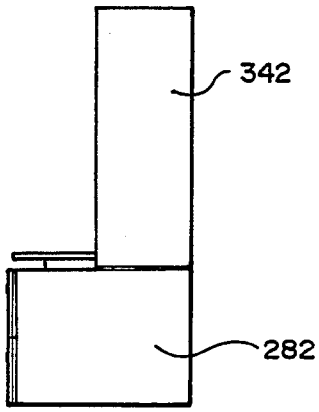
FIG. 39 is an end elevational view of the desk of FIG. 36.
Figure 40:
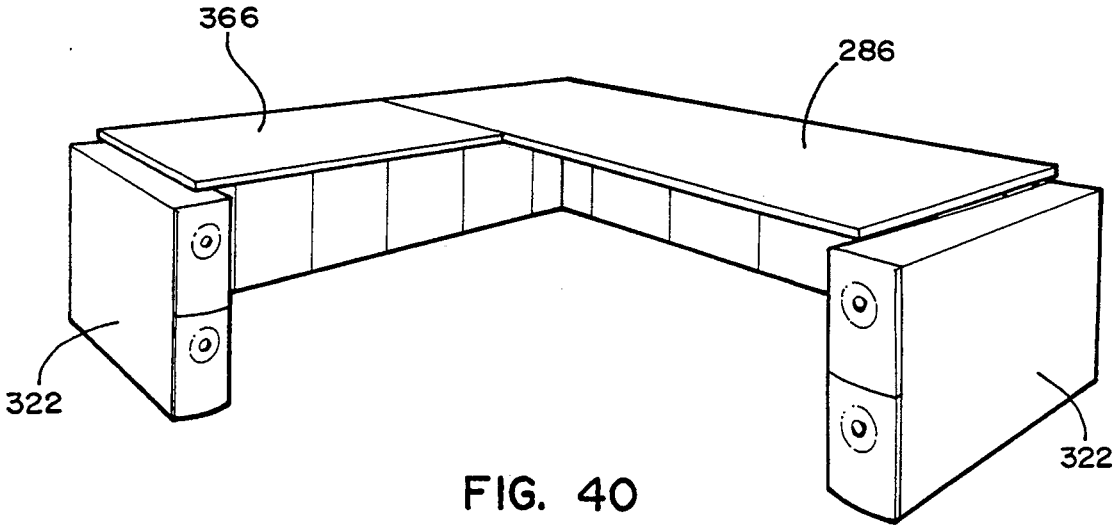
FIG. 40 is a perspective view of an L-shaped desk of the present invention.
Figure 41:
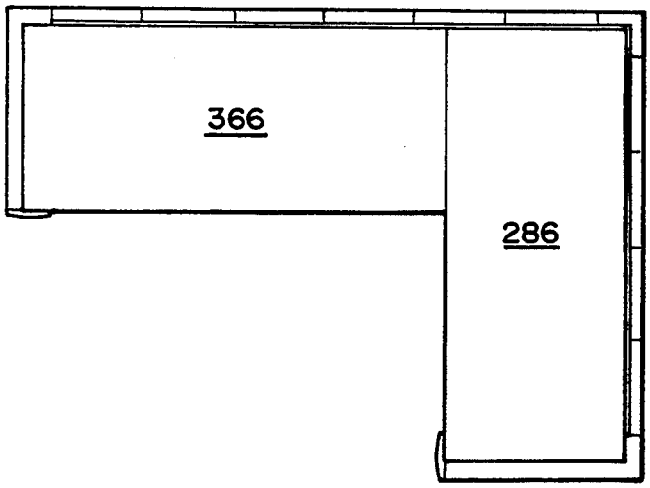
FIG. 41 is a top plan view of the desk of FIG. 40.
Figure 42:
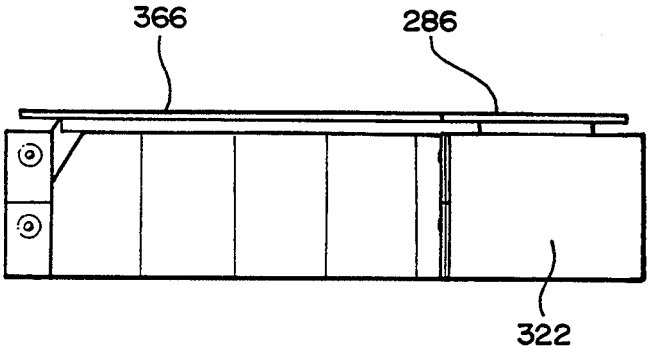
FIG. 42 is a front elevational view of the desk of FIG. 40.
Figure 43:
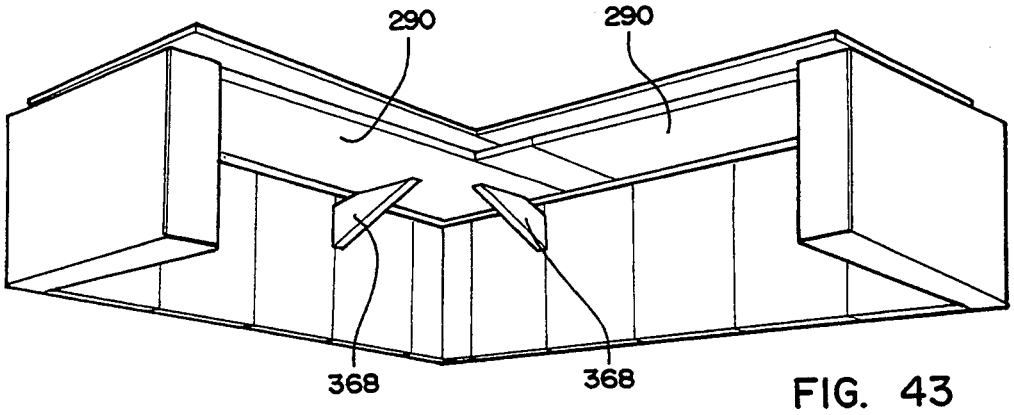
FIG. 43 is a perspective view showing the underside of the desk of FIG. 40.

FIGS. 36–39 show another type of panel that can be mounted on the basic desk construction shown in FIG. 28. In this embodiment, load bearing top panels 340 are bolted to the top of lower panels 322 and are formed in a similar manner. End panels 342 positioned at right angles to panels 340 are attached to the top of pedestals 282. As shown in FIG. 49, spacers 344 are positioned between upper and lower panels so as to leave a gap 346 between the upper and lower panels. These same spacers are employed between panels 342 and the pedestals. A rubber or elastomer blade 348 (FIG. 36) conceals the gap above the pedestal but still permits wires to be tucked in the gap and concealed in the hollow space between panel 342 and pedestal 382. Thus, even with load bearing top panels, it is still possible to conceal wires between the upper and lower panel sections.

Figure 47:
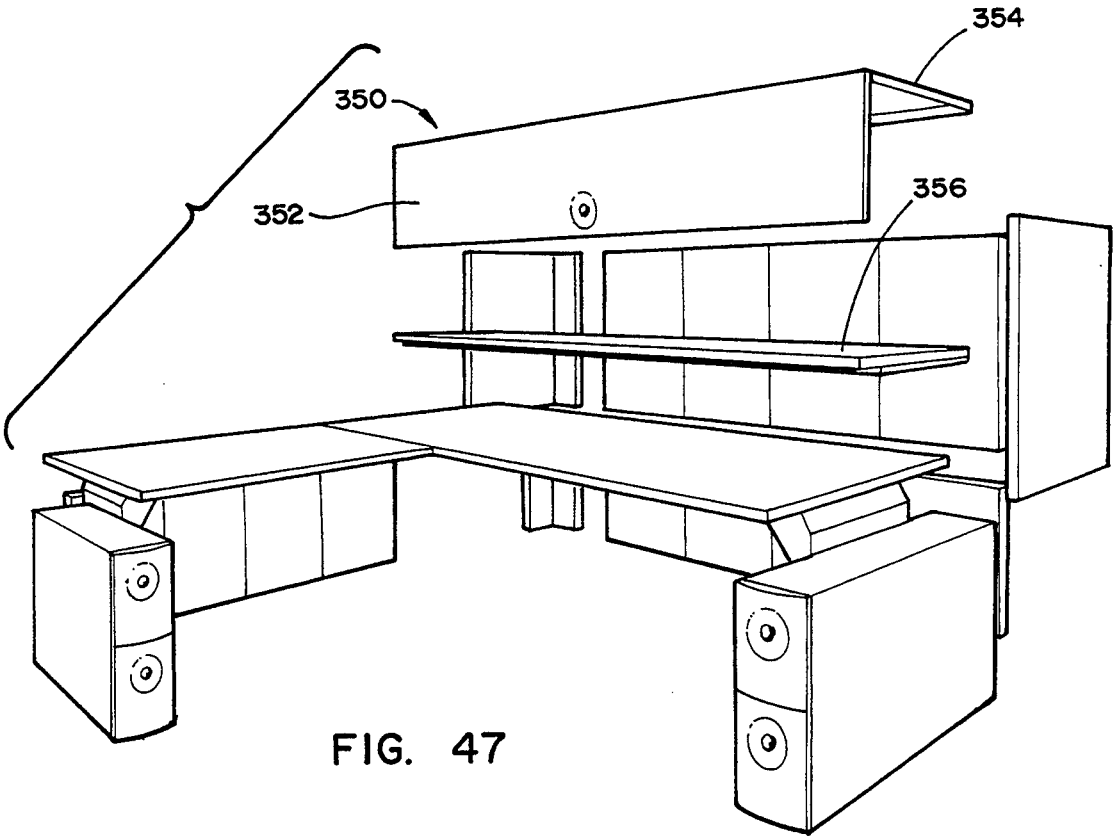
FIG. 47 is an exploded view of the desk of FIG. 40 employing tall top panels and a storage unit.

A storage unit 350 is mounted on the load bearing panels above the desk top. Details of the storage unit are shown in the exploded view in FIG. 47, wherein the storage unit is shown to have a door 352, a top panel 354, and a lower panel 356 that is attached in the manner of a shelf.

The manner in which a shelf 358 is attached to the wall panel is shown in FIG. 49. A stamped metal support bracket 360 below the shelf has a U-shaped rear member 362 with a flange that abuts the panel. This flange can be bolted to the panel. The U-shaped rear member provides a groove behind the shelf for concealing electrical wires. It should be noted that there is a gap 364 (see FIG. 38) between the sides of the desk top 286 and side panels 342

As can be seen, a number of different variations can be achieved with a relatively small number of components. It is important to note that the desk units can include their own screens and panels, even load-bearing panels, and these desks and panels can be arranged independently of the walls and post and beam archistructure. Thus, it is possible to obtain the benefit of wall mounted shelves and storage-units without placing limitations on the wall and archistructure system. The wall and archistructure system can thus be employed for space definition, privacy, individuality, and the like, while the load supporting panels used in the desk system can be designed for the more functional aspects of work efficiency and productivity. Even though these units are independent, they are the same height and all include the same type of wiring connections that permit ample power and communications wiring to be distributed to the proper location without the wiring being visible.

Other arrangements of the desk, top panels, storage units, and shelves are possible. The present description is intended to be exemplary only.

Figure 51:
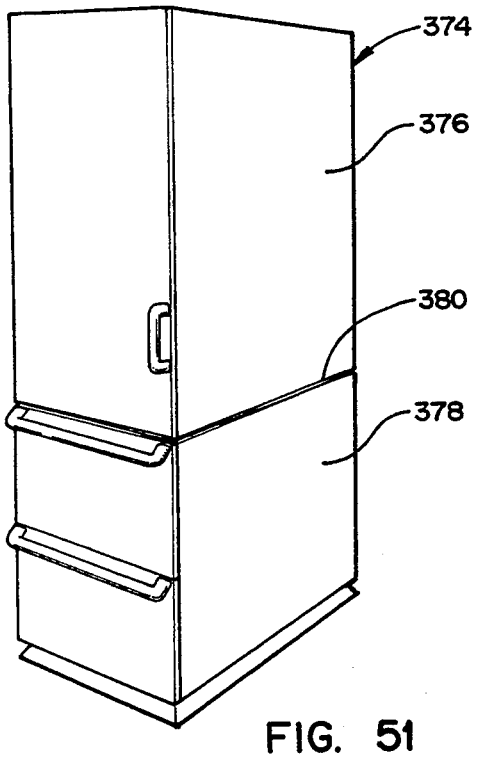
FIG. 51 is a perspective view of a closet and file in accordance with the present invention.
Figure 52:
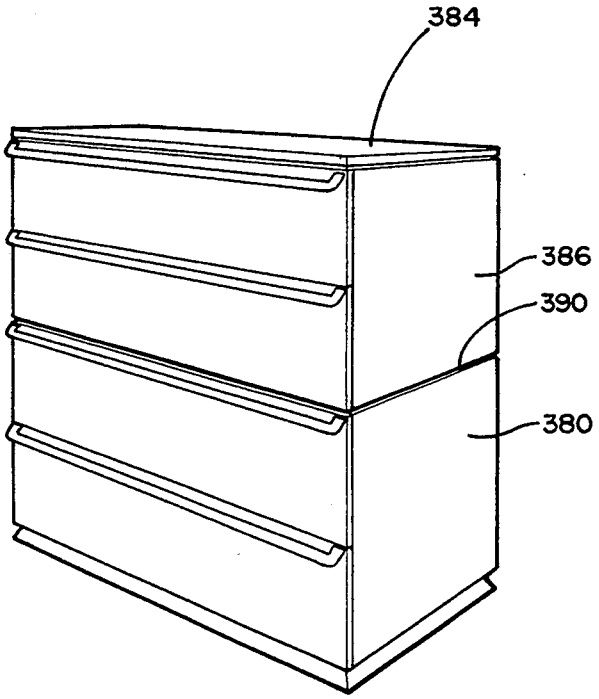
FIG. 52 is a perspective view of a file cabinet in accordance with the present invention.

Two other elements designed to be compatible with the present invention are shown in FIGS. 51 and 52. FIG. 51 shows a combination personal closet and file 374, with the personal closet 376 being mounted on top of a file unit 378, with the same type of space or groove 380 between the upper and lower sections to create the same compatibility appearance with the other units in the system. The grooves can be provided so that wiring can be hidden in the grooves.

FIG. 52 discloses a file storage unit 384 with upper and lower Sections 386 and 388 being separated by a The embodiments of the present invention in which an exclusive property or privilege is claimed are defined as follows:

1. A room divider panel system including at least one modular room divider panel wall and at least one free standing desk that forms an integral part of the room divider panel wall, wherein:

the room divider panel wall includes a plurality of interconnected room divider base wall panels formed in individual panel modules of uniform height and width, the base wall panels forming a base wall that extends upwardly to approximately the height of a desk, the base wall panels having interior peripheral frames that are connected together edge to edge, decorative exterior surface covers fitting on and covering the frames so as to form a continuous base wall structure;

the free standing desk comprises a work surface is mounted on vertical support members at side edges of the work surface, the vertical support members being same height as the base wall panels and being a depth that is an even multiple of the width of the base wall panel modules, the desk including a back panel that extends across the back of the desk between the vertical support members, the back panel being formed from a plurality of back panel sections having the same height and width as the base wall panel modules, with the back panel sections being formed of interconnected frames and exterior surface covers having the same shape and exterior appearance as the base wall panel modules, the rear and side edges of the work surface being spaced inwardly of the outer edges of the vertical support members and desk back panel such that upper panels as thick as the desk back panels can be mounted on the tops of the vertical support members and desk back panels.

2. A room divider panel system according to claim 1 wherein one or more vertical support members is a pedestal incorporating a drawer unit.

3. A room divider system according to claim 1 and further comprising upper wall panels mounted on at least some of the base wall or desk back panels or the vertical support members, the upper wall panels including a plurality of upper wall panel sections that are of the same width as the base wall panels and extending upwardly to form a higher panel than the base wall panels, the upper wall panels having exterior covers that have the same general appearance as the exterior appearance of the base wall panels.

4. A room divider system according to claim 1 and further comprising a screening panel removably mounted on the top of the desk back panel and extending upwardly therefrom to serve as a visual screen for the rear of the desk, the screening panel extending the width of the desk and being the thickness of the back panel, the screening panel being formed of a light weight, non-load bearing material such that it cannot serve as a support wall for cantilever-mounted accessories.

5. A room divider system according to claim 1 wherein lower edges of the room divider panel walls, vertical support members, and desk back panels extend downwardly all the way to the floor, such that they have the appearance of floor-mounted walls.

6. A free standing desk comprising:

a work surface having a straight rear edge and opposite side edges perpendicular to the rear edge;

a transverse metal support beam mounted on the underside of the work surface, the support beam being in the form of an open topped tray providing space for housing electrical components and wiring, the support beam having openings in a bottom thereof at one or more ends of the tray;

cross braces at the ends of the support beam, each cross brace being connected at a horizontal upper side to an underside of the support beam and extending downwardly and outwardly therefrom at an inclined angle, each cross brace being connected at a vertical outer side thereof to a vertical inner side of a pedestal, each cross brace having an opening extending therethrough from the vertical outer side to the horizontal upper side, with the opening in the upper side mating with the opening in the bottom of the support beam, the cross braces suspending the work surface above the tops of the pedestals while providing wiring passageways from the pedestals to the interior of the support beam.

7. A freestanding desk according to claim 6 wherein wiring terminals for the wiring are mounted in the open interior of the support beam, and the work surface includes an opening therein that provides access to the wiring terminals.

8. A room divider panel system including at least one modular room divider panel wall and at least one free standing desk that forms an integral part of the room divider panel wall, wherein:

the room divider panel wall includes a plurality of interconnected room divider base wall panels formed in individual panel modules of uniform height and width, the base wall panels forming a half wall that extends upwardly to approximately the height of a desk, the base wall panels having interior peripheral frames that are connected together edge to edge, decorative exterior surface covers removably fitting on and covering the frames so as to form a continuous half wall structure;

the free standing desk is a pedestal desk wherein a rectangular work surface having front, rear, and side edges is mounted on pedestal type vertical support columns at least partially under side edges of the work surface, the pedestals being the same height as the base wall panels and being a depth from the front to the back of the desk that is an even multiple of the width of the base wall panel modules, the desk including a back panel that extends across the back of the desk between the pedestals, the back panel being formed from a plurality of back panel sections having the same height and width as the base wall panel modules, with the back panel sections being formed of interconnected frames and exterior surface covers having the same shape and exterior appearance as the base wall panel modules, the width of the desk, including the pedestals, being an even multiple of the width of the base panel modules, such that the desk can be used by itself as a stand alone desk or it can be incorporated into a room divider system where the pedestal and back panel of the desk serve as an integral part of the half wall structure;

a transverse support beam being mounted on the underside of the work surface and extending from side to side, the beam having a recessed open interior that provides a wiring receptacle under the work surface;

the work surface being mounted at each end to a pedestal as a floating desk top by means of cross braces, each cross brace comprising a hollow inclined frame member attached to the underside of the support beam and extending downwardly and outwardly and is connected to an inner side of the pedestal, the hollow frame member including openings at each end that provide communication between the open interior of the support beam and an open interior of the pedestal, such that wiring can be routed to the work surface upwardly through the interior of the pedestal, through the hollow frame member and into the open interior support beam, the work surface having access means for accessing wiring in the open interior of the support beam from the top of the work surface.

9. A room divider system according to claim 8 wherein wiring terminals for the wiring are mounted in the open interior of the support beam, and the work surface access means includes an opening therein in the work surface that provides access to the wiring terminals.

* * * * *

UNITED STATES PATENT AND TRADEMARK OFFICE

CERTIFICATE OF CORRECTION

PATENT NO. : 5,394,658

DATED : Mar. 7, 1995

INVENTOR(S) : Schreiner et al.

It is certified that error appears in the above-identified patent and that said Letters Patent is hereby corrected as shown below:

Column 1, line 31:

"Office" should be --office--;

Column 4, line 26:

"assemblage" should be --assemblable--;

Column 8, line 45-46:

"continuous" should be --continues--;

Column 10, line 26:

"tail" should be --tall--;

Column 11, line 15:

"Connector" should be --connector--;

Column 12, line 46:

After "342" insert (Page 26) -- which permits wires to be tucked under the side edges of the desk top.

A modification of the desk construction of FIG. 28 is shown in FIGS. 40 - 43. In this embodiment, the pedestals 322 are positioned at right angles and an additional right angle desk top section 366 is It is certified that error appears in the above-identified patent and that said Letters Patent is hereby corrected as shown below:

attached at right angles to one end of desk top 286. Both sections of desk top employ support beams 290, with these beams being bolted together where they intersect. Additional support braces 368 are provided for additional support at the corner of the desk. The other features of this type of unit are substantially the same as the previous embodiments.

Figure 44:
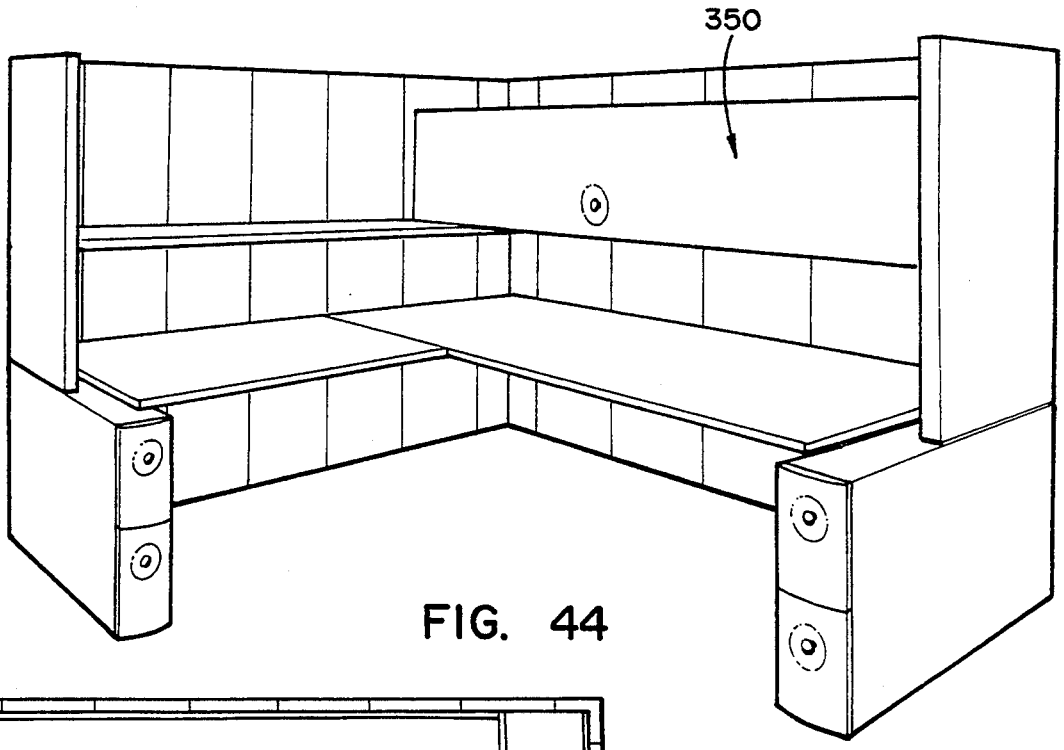
FIG. 44 is a perspective view of the desk of FIG. 40 employing top tall panels, a shelf, and a storage unit.
Figure 45:
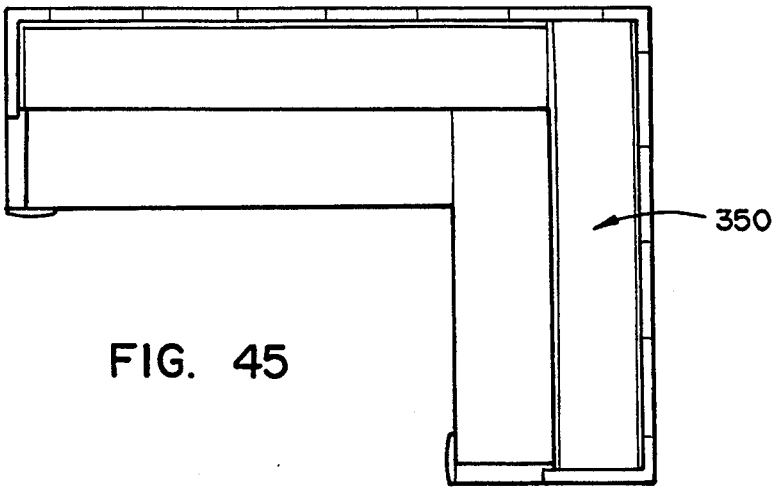
FIG. 45 is a top plan view of the desk of FIG. 44.
Figure 46:
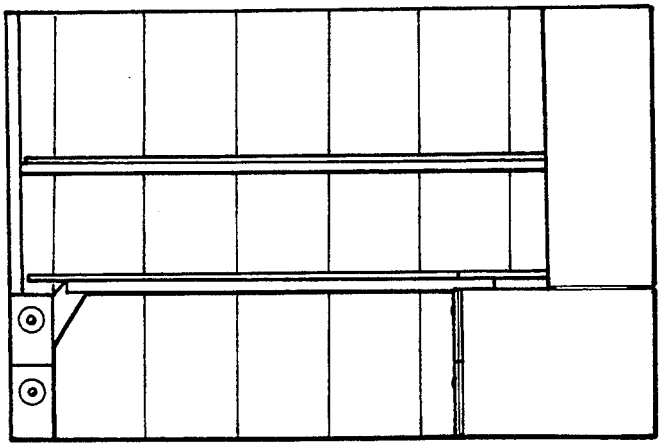
FIG. 46 is a front elevational view of the desk of FIG. 44.

The L-shaped desk also can have top panels and storage units and shelves mounted on the top panels, as shown in FIGS. 44 - 46. The storage unit 350 is mounted in the same manner as previously described. The shelf unit is mounted in a similar manner and is attached to the storage unit at one end.

Figure 48:
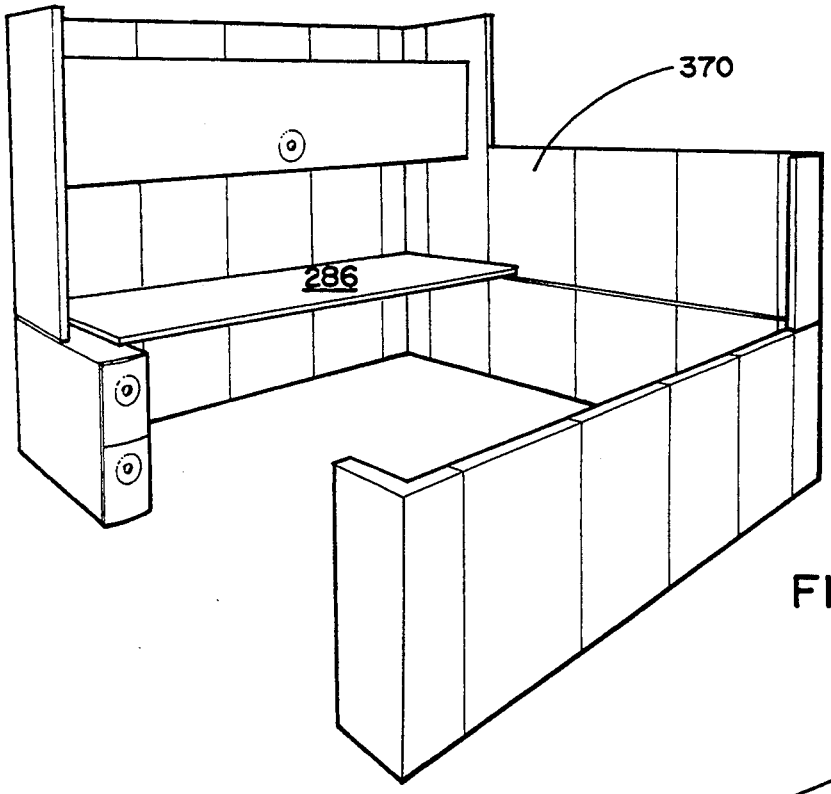
FIG. 48 is a perspective view of the desk of the present invention, showing the enclosure of the desk area by means of extended bottom panels and short top panels as screening.

Still another modification of the desk unit of the present invention is shown in FIG. 48. In this unit, a desk top 286 is mounted to a pedestal at one end and to a lower support panel 322 at the other end by the same type of beam and brace arrangement for the FIG. 32 embodiment. In this arrangement, however, the lower support panels not only form It is certified that error appears in the above-identified patent and that said Letters Patent is hereby corrected as shown below:

back panels but they also form side panels and extend all the way around behind the desk unit. Half height top panels 370 are positioned above the lower panels on one side of the desk in order to vary the aesthetic appearance of the desk unit.--

Column 13, line 11:

"Sections" should be --sections--;

Column 13, line 11, insert (Page 28) --groove 390 that is compatible with the grooves in the other elements of the furniture. The groove again can be deep enough to provide a means for concealing wiring that must pass around the storage unit.

It should be understood that the foregoing is merely exemplary of the preferred practice of the present invention and that various changes and modifications may be made in the arrangements and details of construction of the embodiments disclosed herein without departing from the spirit and scope of the present invention.--

UNITED STATES PATENT AND TRADEMARK OFFICE

CERTIFICATE OF CORRECTION

PATENT NO. : 5,394,658

DATED : Mar. 7, 1995

INVENTOR(S) : Schreiner et al.

It is certified that error appears in the above-identified patent and that said Letters Patent is hereby corrected as shown below:

Column 13, line 29:

delete "is";

Line 32, add--the-- before "same".

Signed and Sealed this

Twenty-fifth Day of June, 1996

*Attest:*

*Attesting Officer*

BRUCE LEHMAN

*Commissioner of Patents and Trademarks*